US012458060B2

(12) United States Patent
Breiwa, III et al.

(10) Patent No.: US 12,458,060 B2
(45) Date of Patent: Nov. 4, 2025

(54) SIPHON POWERED SUCTION DEVICE

(71) Applicant: DynaVap, LLC, DeForest, WI (US)

(72) Inventors: George R. Breiwa, III, Dane, WI (US); Troy G. Sonnleitner, Sun Prairie, WI (US)

(73) Assignee: DynaVap, LLC, Windsor, WI (US)

( * ) Notice: Subject to any disclaimer, the term of this patent is extended or adjusted under 35 U.S.C. 154(b) by 0 days.

(21) Appl. No.: 18/905,009

(22) Filed: Oct. 2, 2024

(65) Prior Publication Data

US 2025/0107566 A1 Apr. 3, 2025

Related U.S. Application Data

(60) Provisional application No. 63/542,198, filed on Oct. 3, 2023.

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS 4,140,138 A * 2/1979 Keller ..... A24F 1/30 131/194
4,989,760 A 2/1991 Songzeng
8,763,625 B1 7/2014 Carter
10,342,255 B2 7/2019 Huston et al.
11,116,249 B2 9/2021 Hemphill et al.
2006/0144439 A1 7/2006 Bell
2008/0072917 A1 3/2008 Lee
2020/0229491 A1 7/2020 Williams
2021/0195943 A1 7/2021 Williams
2021/0289843 A1 9/2021 Trzecieski

FOREIGN PATENT DOCUMENTS

CN 204351062 U 12/2014

OTHER PUBLICATIONS

University of Wisconsin Whitewater, Wisconsin Innovation Service Center New Product Assessment: Bottle Buddy, 15 pages.
https://my-ibisworld-com.libproxy.uww.edu:9443/us/en/industry-specialized/od6170/industry-outlook (only accessible by UW Whitewater students, staff, and faculty).
https://my-ibisworld-com.libproxy.uww.edu:9443/us/en/industry-specialized/od4142/industry-outlook (only accessible by UW Whitewater students, staff, and faculty).

(Continued)

*Primary Examiner* — Dennis R Cordray
(74) *Attorney, Agent, or Firm* — Boardman & Clark LLP

(57) ABSTRACT

A siphon powered suction device, methods of operation of the siphon powered suction device and kit for assembly of same are disclosed, the device allows a user to create his or her own gravity water device from readily available glassware without modification, which is made of a central member having an inlet and an outlet and opposed cavities; a check valve assembly biased open as to the outlet; and a mechanism for coupling two vessels to opposing ends of the central member, a method operational of the device and cleaning the device is disclosed, a kit for assembly of the device is disclosed, and a support structure for operation of the device is disclosed.

14 Claims, 19 Drawing Sheets

(56) References Cited

OTHER PUBLICATIONS https://my-ibisworld-com.libproxy.uww.edu:9443/us/en/industry-specialized/od3315/industry-outlook (only accessible by UW Whitewater students, staff, and faculty).
https://canadapuffin.com/products/arctic-bubbler-glass-water-pipe.
https://iconhookah.com/products/ykap-mini-str-hookah.
https://smokeheir.com/products/waterpipe?variant=45184857178404.
https://www.marleynaturalshop.com/products/smoked-glass-bubbler.
https://ardentcannabis.com/product/nova-fx/.
International Search Report and Written Opinion of the International Searching Authority dated Jan. 27, 2025 for PCT/US2024/049624 filed Oct. 2, 2024,11 pages.

* cited by examiner

SIPHON POWERED SUCTION DEVICE

CROSS-REFERENCE TO RELATED APPLICATIONS

This application claims the priority as a non-provisional application of U.S. Application No. 63/542,198 filed Oct. 3, 2023, the entire contents of which is hereby incorporated by reference in its entirety herein.

BACKGROUND

Gravity water devices are known and are generally known in the art. However, the prior art devices are generally housed in a permanent structure. Though the structure provides for rotation of the device about an axis, the result is the device and structure are bulky and lack user ease of function. Additionally, prior art devices require specific fluid housings making the prior art devices incapable of accommodating different fluid housings which could accommodate various volumes of fluid. With that, the designs of the prior art devices and structures housing provide for housing the in-take and water displacement components to be housed in the rotational feature of the prior art device and structure. As a result, the prior art device and structure is designed in a way resulting in a device and structure which is limited in use based upon the location, the device and structure need to be placed on a flat surface. Further, the prior art device and structure is fragile because the working components of the intake and water displacement are intertwined with the rotational housing that governs rotation of the device. Thus, where the rotational components fail the device is inoperable. Finally, the encasement of the intake and water displacement components in the rotational housing result in increased difficulty accessing the intake and water displacement components for regular maintenance.

With that, a need exists for a device that allows a user to create their own gravity water device or siphon powered suction device from readily available glassware.

A need exists for a device which contains a structural integrity which resists damage due to repeated user operation.

A need exists for a device which provides for ease of disassembly in order to clean the components of the device and store such components.

Further, a need exists for a system and method for compartmentalizing the components of the device for increased accuracy, efficiency, and case of cleaning and/or storage.

SUMMARY

Accordingly, a siphon powered suction device and kit for assembly of same are disclosed. The device allows a user to create his or her own gravity water device from readily available glassware without modification. It is composed of a housing that couples to two bottles, forming a handle therebetween, and has internal components that control water and vapor flow.

In an embodiment, a siphon powered suction device comprises the following: a central member having an inlet and an outlet and opposed cavities; a check valve assembly biased open as to the outlet; and an elastomeric mechanism for coupling two vessels to opposing ends of the central member.

The siphon powered suction device may further comprise: siphon powered suction device of claim 1, wherein the inlet comprises an inlet aperture and an inlet tube, with the inlet aperture molded into the central member and the inlet tube positioned substantially orthogonal to the inlet aperture in the opposed cavities, and the outlet comprises an outlet aperture and an outlet tube, with the outlet aperture molded into the central member and the outlet tube positioned substantially orthogonal to the outlet aperture in the opposed cavities; the central member has a separator plug within the cavity and position at least substantially orthogonal to the inlet and the outlet, with the separator plug housing the inlet aperture and the outlet aperture; the inlet tube and the outlet tube extend substantially parallel to another through the cavity and extend beyond the central member at a first end and an opposite second end; the check valve assembly is positioned through the outlet tube; the check valve assembly comprises a rod and connecting geometric ends of the rod along a length of the check valve assembly, with each geometric end removably sealing to a respective end of the outlet dependent upon an orientation of the central member, with the rod having a corrugated orientation along the length, wherein the corrugated orientation provides for alignment of each geometric end to with the respective end to provide for the sealing; a support structure for a rotational operation of the central member and removal of a fluid from at least one of the central member and the vessels; the elastomeric mechanism is an elastomeric material allowing for a second sealing of one of an inner diameter and an outer diameter of each vessel to a respective opposing end; and a kit incorporating the central member, the check valve assembly, the inlet tube, and the outlet tube.

In an embodiment, a method of operation of a siphon powered suction device comprises the following: transferring a product fluid into a housing of the siphon powered suction device; advancing the product fluid to a first chamber; repositioning a second fluid in the first chamber to a second chamber; reorienting the first chamber with respect to the second chamber; and evacuating the product fluid in the first chamber.

The method of operation of the siphon powered suction device may further comprise: the repositioning of the second fluid provides for a vacuum transferring the product fluid into the housing, and the reorienting of the first chamber causes the product fluid in the first chamber to enter an outlet tube; preventing a flow of the second fluid into the outlet tube by a check valve scalable to the outlet tube; sealably coupling the first chamber and the second chamber to the housing by an application of elastomeric properties of the housing; attaching accessories to an inlet for the transferring of product fluid and attaching receiving accessories to an outlet for the evacuating by the application of elastomeric properties; and a compartmentalized cleaning of the device.

In an embodiment, a rotational siphon powered suction device comprises the following: a housing with an inlet port and a diametrically opposed outlet port; an inlet aperture fluidly connected to the inlet port; an outlet aperture fluidly connected to the outlet port; an inlet tube in operative contact with the inlet aperture for receipt of a combustion emission from the inlet aperture; an outlet tube operatively connected to the outlet aperture for transmission of the combustion emission; and an elastomeric seal for coupling two vessels to opposing ends of the housing.

The rotational siphon powered suction device may further comprise: the inlet aperture is molded into a central member of the housing and the inlet tube is positioned substantially orthogonal to the inlet aperture, and the outlet aperture is molded into the central member opposite the inlet aperture and the outlet tube is positioned substantially orthogonal to the outlet aperture; a check valve assembly is positioned through the outlet tube, with the check valve assembly having a rod and connecting geometric ends of the rod along a length of the check valve assembly, with each geometric end removably sealing to a respective end of the outlet tube dependent upon an orientation of the housing, and the rod has a corrugated orientation along the length, with the corrugated orientation providing for alignment of each geometric end to with the respective end to provide for the sealing; a support structure for a rotational operation of the housing and removal of a fluid from at least one of the housing and vessels sealably attached to the housing; and a rotational inlet accessory sealably attached to the inlet aperture through the inlet port, with the rotational inlet accessory having a rotation when the housing is rotated to maintain a position of the rotational inlet accessory with respect to the housing.

It is understood that "fluid", "product", "product fluid, "product liquid", "liquid", "gas(es)", "vapor(s)" reference the product delivered into and through the device as disclosed in the application.

Improving the structure and operation, method of use, of fluid transfer devices to allow a user to create their own gravity water device or siphon powered suction device from readily available glassware provides specific ergonomic and design advantages. Further, the improved design provides for a simplified robust application of the fluid transfer device. These and other features, advantages, and embodiments of apparatus, systems, and methods according to this invention are described herein, or are apparent from, the following detailed descriptions of the various examples of embodiments.

BRIEF DESCRIPTION OF DRAWINGS

Various examples of embodiments of the systems, devices, and methods according to this invention will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring to the Figures, a siphon powered suction device 100 and kit for assembly of same is provided herein. The siphon powered suction device 100 for improved operation in filtration of materials, and a system and method for compartmentalizing and storage of the siphon powered suction device 100 and kit.

Figure 1:
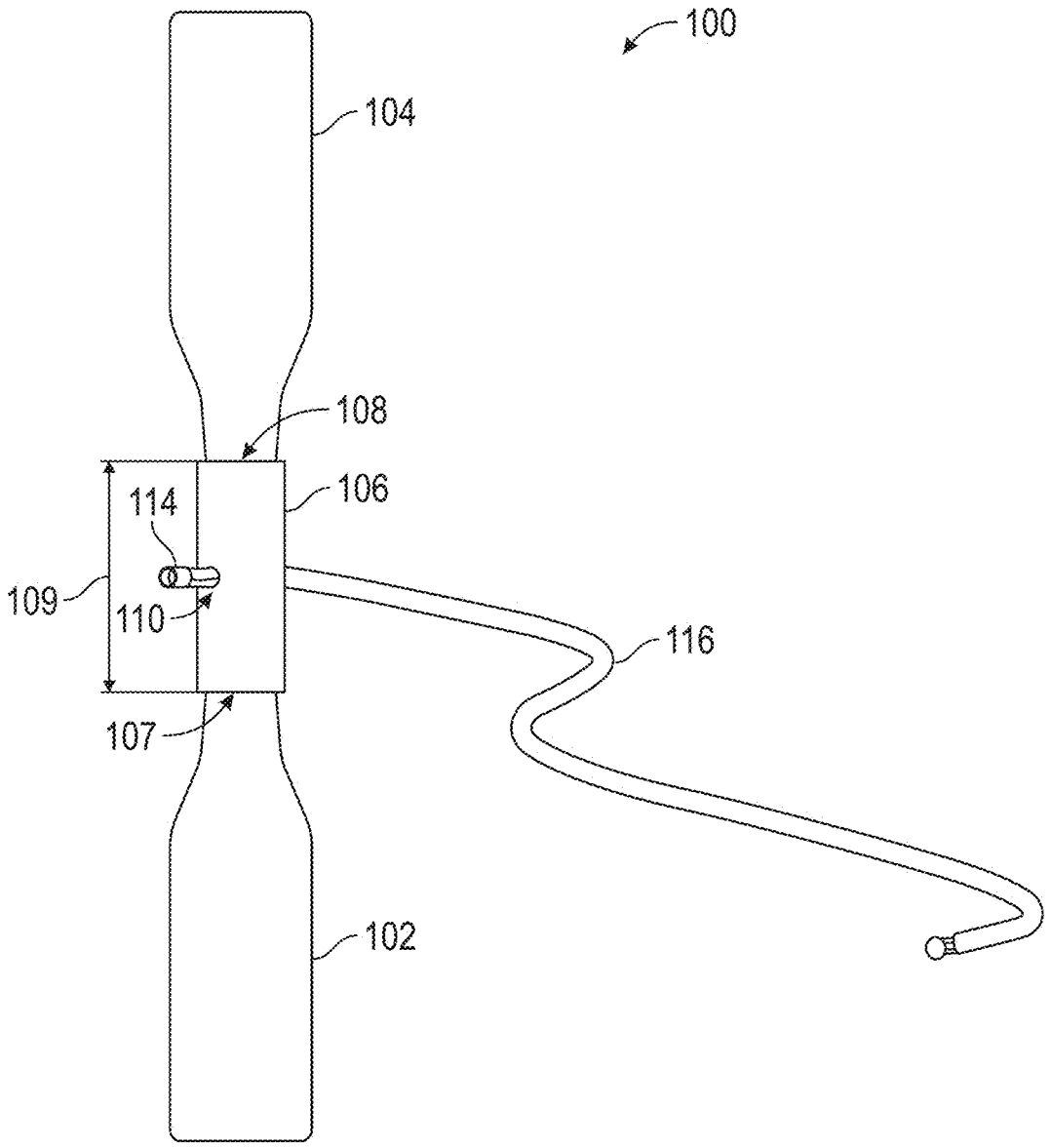
FIG. 1 is a perspective view of a siphon powered suction device according to one or more examples of embodiments.
Figure 2:
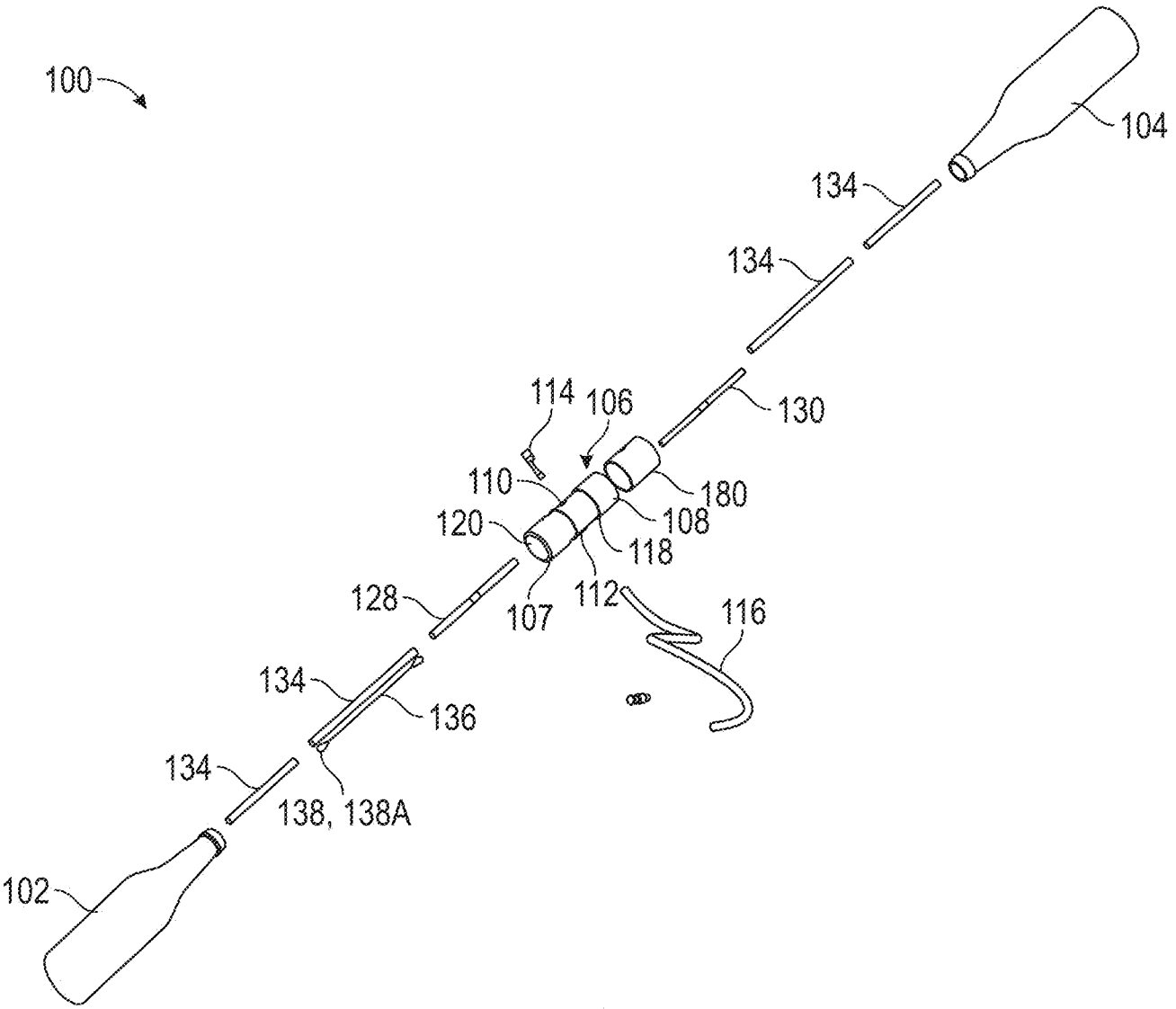
FIG. 2 is an exploded view of the siphon powered suction device shown in FIG. 1.
Figure 8:
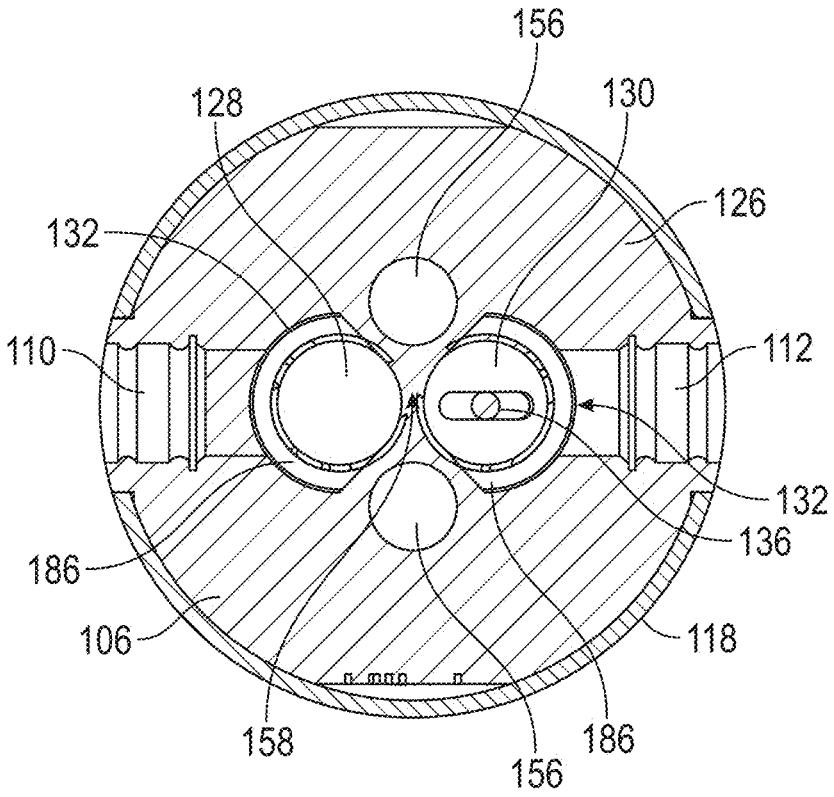
FIG. 8 is an end elevation view of the assembly shown in FIG. 5, showing the top or bottom of the assembly, with inlet tube, outlet tube and check valve, and drain ports visible.

With attention to FIGS. 1 and 2, the siphon powered suction device 100 utilizes gravity to, first, intake vapor or smoke from a device, joint, blunt, bowl, etc., by displacing water held in a vessel assembly. The assembly generally comprises two vessels (102, 104), such as bottles, flasks or the like, coupled together by a central coupling member 106 which also serves as a handle. The central coupling member 106 has a coupling member first end 107 and opposite coupling member second end 108. The first end 107 and the second end 108 are separate by a coupling member length 109 which defines a long axis of the coupling member 106. The first vessel 102 is removably and scalably attached to the first end 107. The second vessel 104 is removable and scalably attached to the second end 108. The central coupling member 106 has an inlet aperture 110 (see FIG. 8) and outlet/exit aperture 112 (see FIG. 8) and a mechanism or assembly for transfer of fluid, smoke and or vapor between the inlet 110, the vessels (102, 104), and the outlet/exit 112. Optionally, a bowl 114 and a smoke or vapor delivery device such as a whip 116 or hose may be attached. For example, the bowl 114 may be attached to the inlet 110 (see FIG. 8). Further, the smoke or vapor delivery device such as a whip 116 or hose may be attached to outlet/exit aperture 112 (see FIG. 8).

Figure 3:
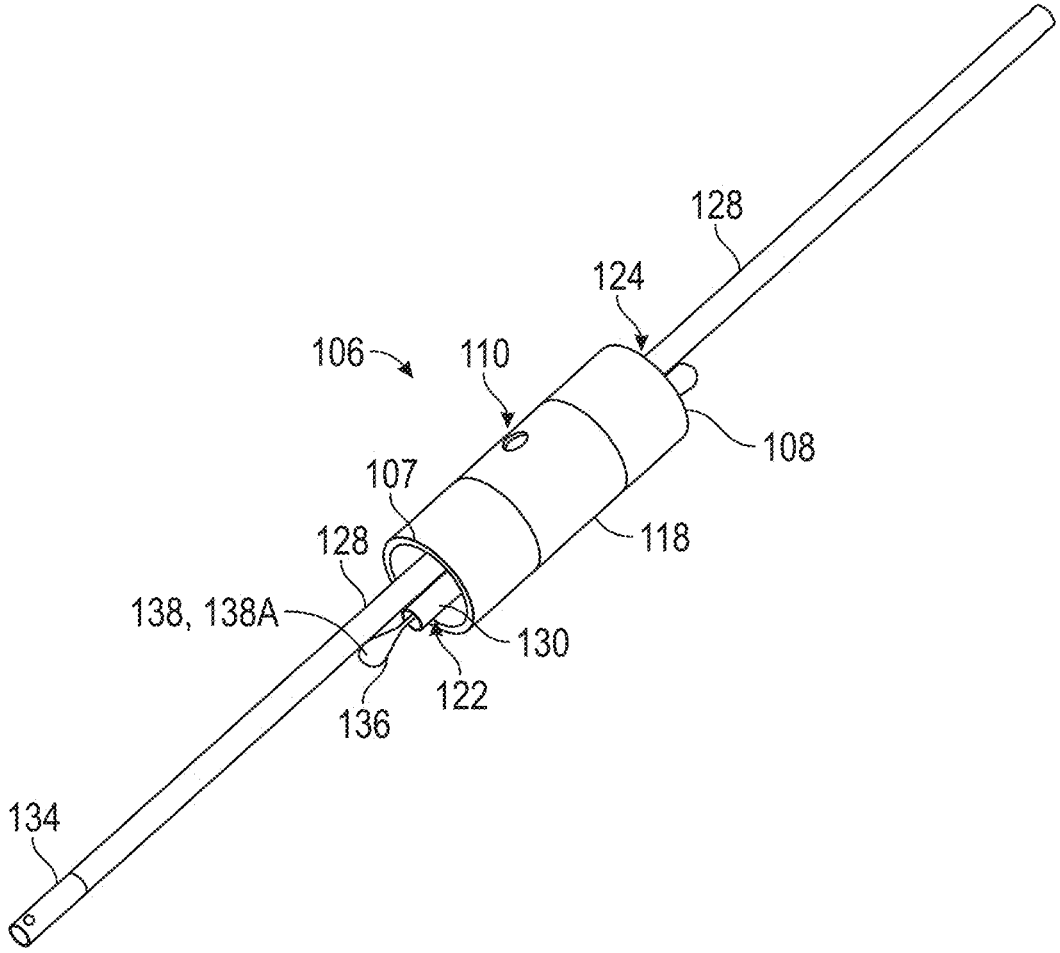
FIG. 3 is a perspective view of an assembly for use with the siphon powered suction device shown in FIG. 1, showing the central coupling member, inlet tube, outlet tube with check valve assembly, and a first aspect of a bowl.
Figure 4:
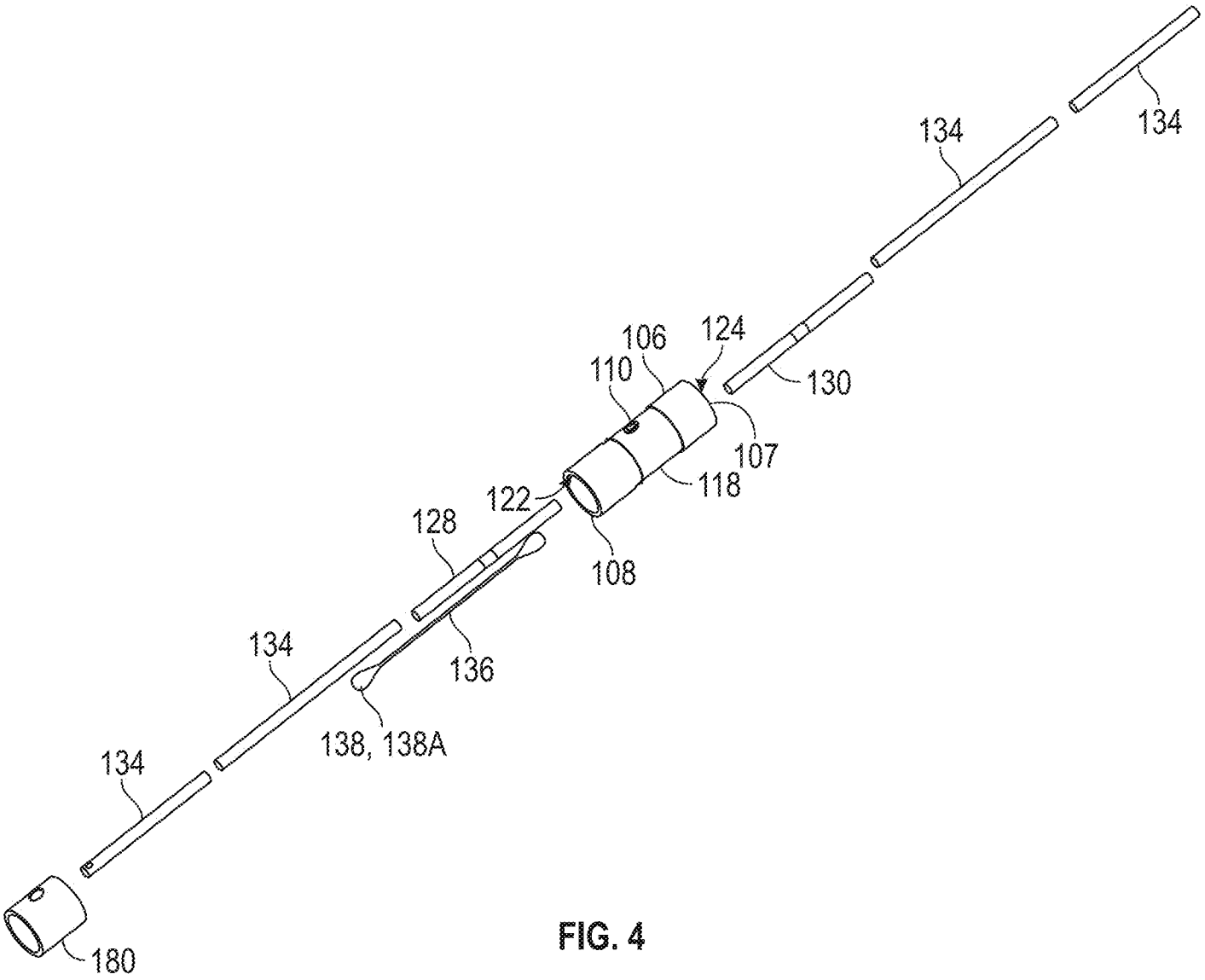
FIG. 4 is an exploded view of the assembly shown in FIG. 3.
Figure 5:
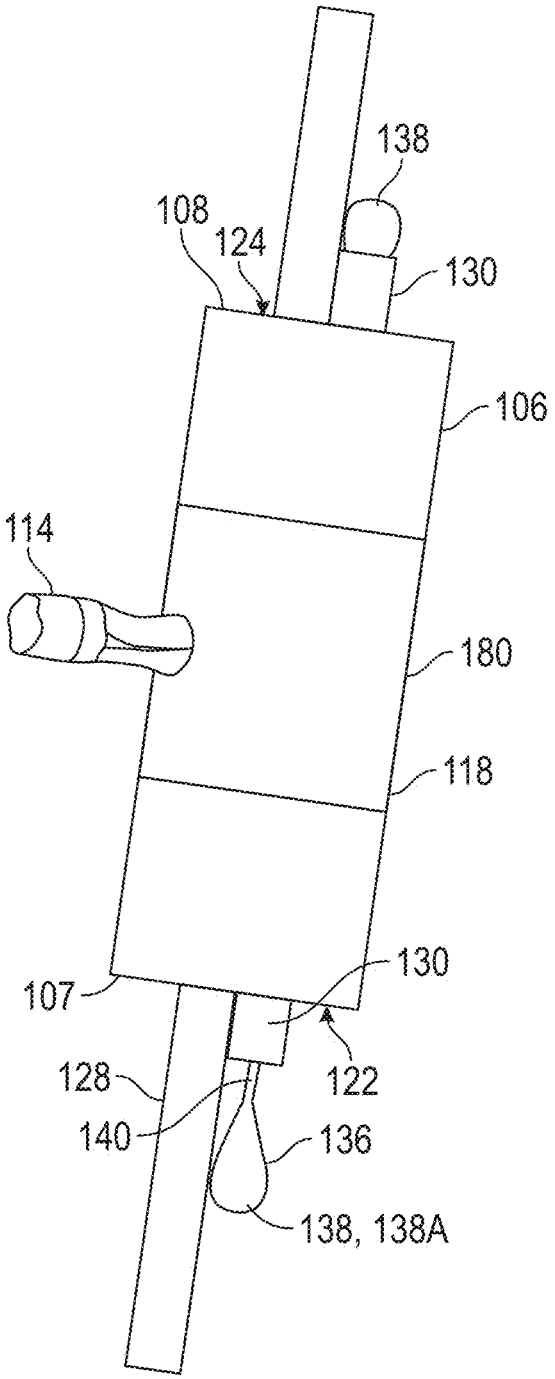
FIG. 5 is a close-up perspective view of the assembly shown in FIG. 3.

With attention to FIGS. 2 to 4, the siphon powered suction device 100 comprises the central coupling member 106 comprises a shell 118 that holds operational components (see FIGS. 6 and 7) of the device 100. A combination of the shell 118 and the first end 107 and the second end 108 define a cavity volume 120 coupling member 106. The cavity volume 120 extends the length 109 opening to the environment at the first end 107 and the second end 108. Further the cavity volume 120 is subdivided into a first volume 122 and a second volume 124 by the separator plug 126 such that the first volume 122 and the second volume are isolinear along the length. The first volume opening to the first end 107 and the second volume opening to the second end 108.

Figure 6:
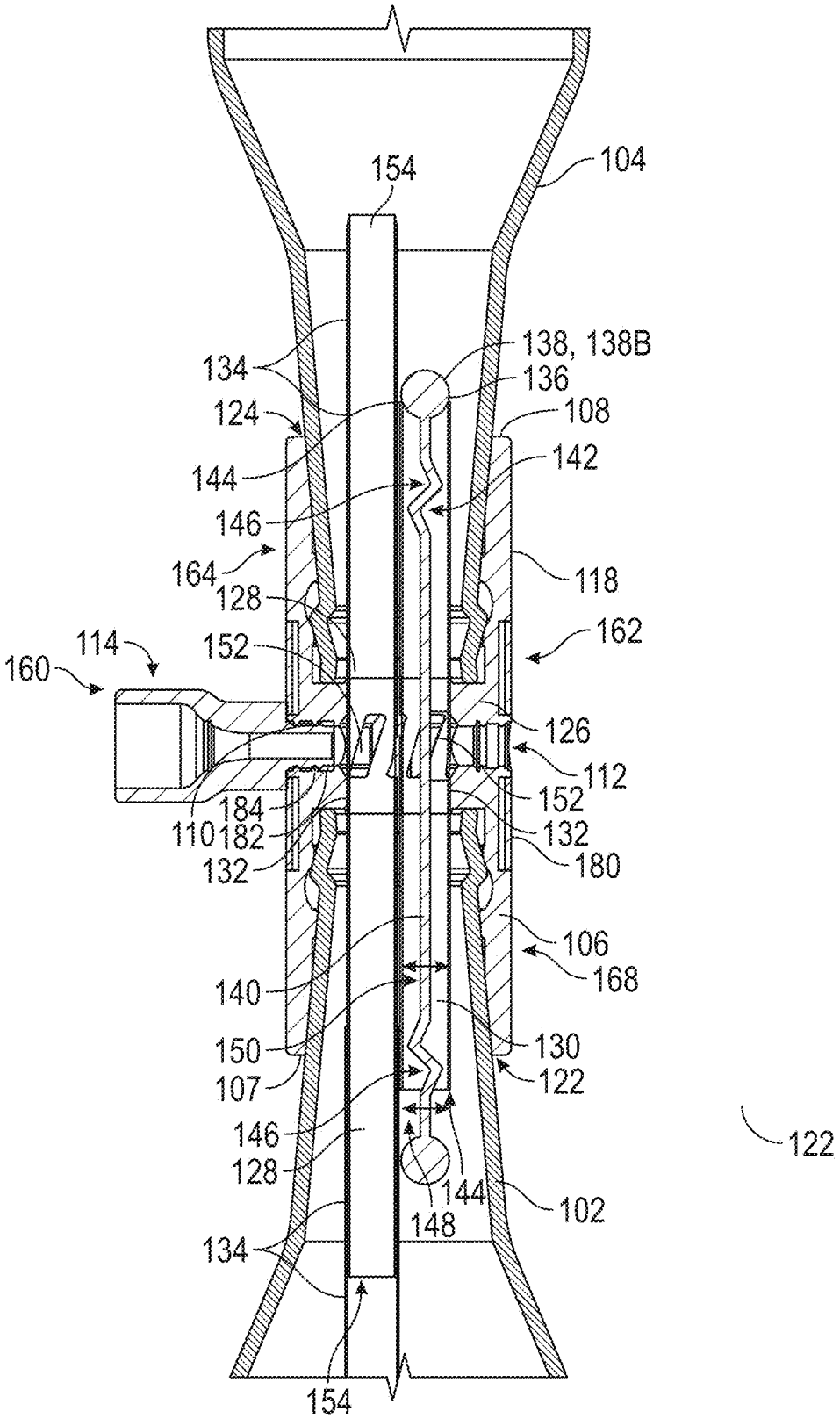
FIG. 6 is a cross-sectional view of the assembly shown in FIG. 5, including two vessels attached thereto.
Figure 7:
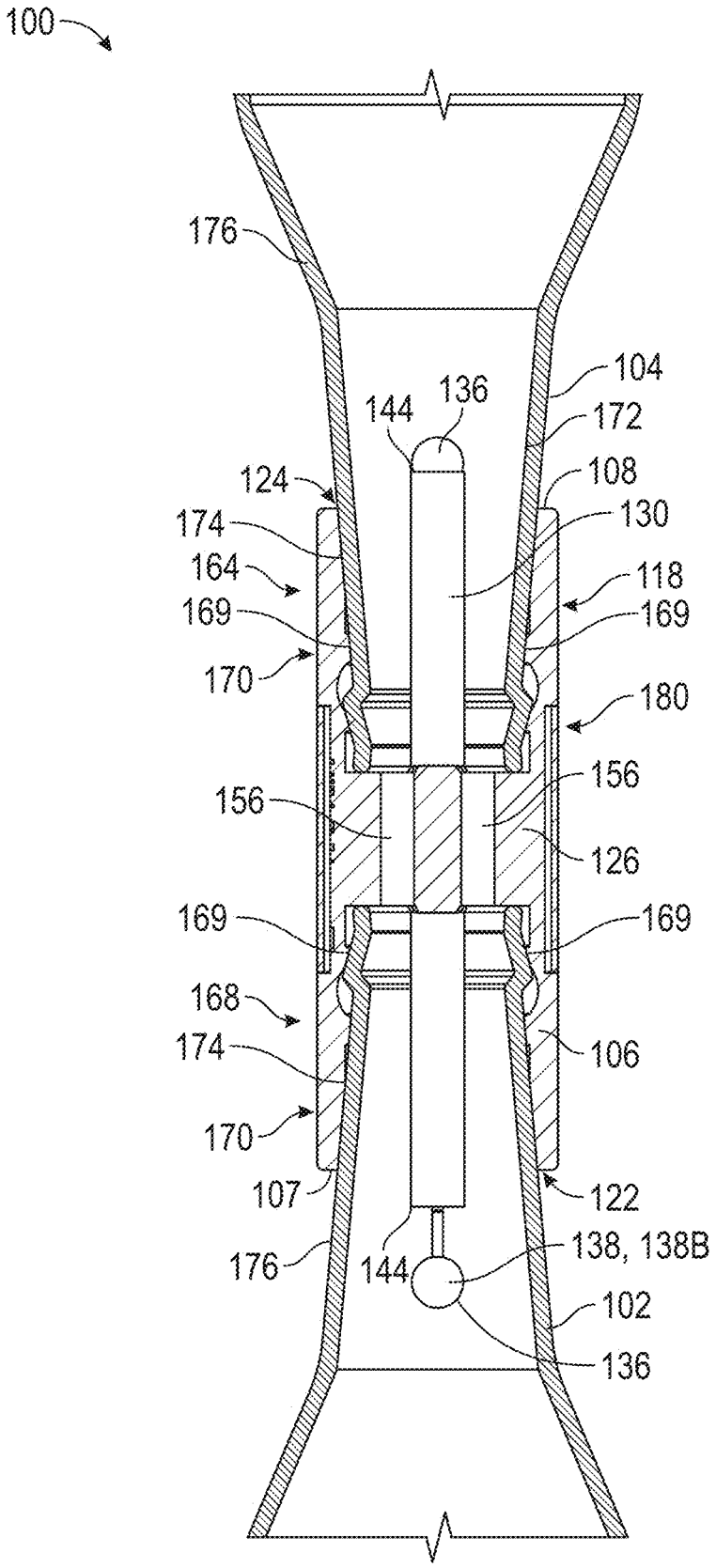
FIG. 7 is an additional cross-sectional view of the assembly shown in FIG. 5, including two vessels attached thereto and taken from a different point than FIG. 6.
Figure 9:
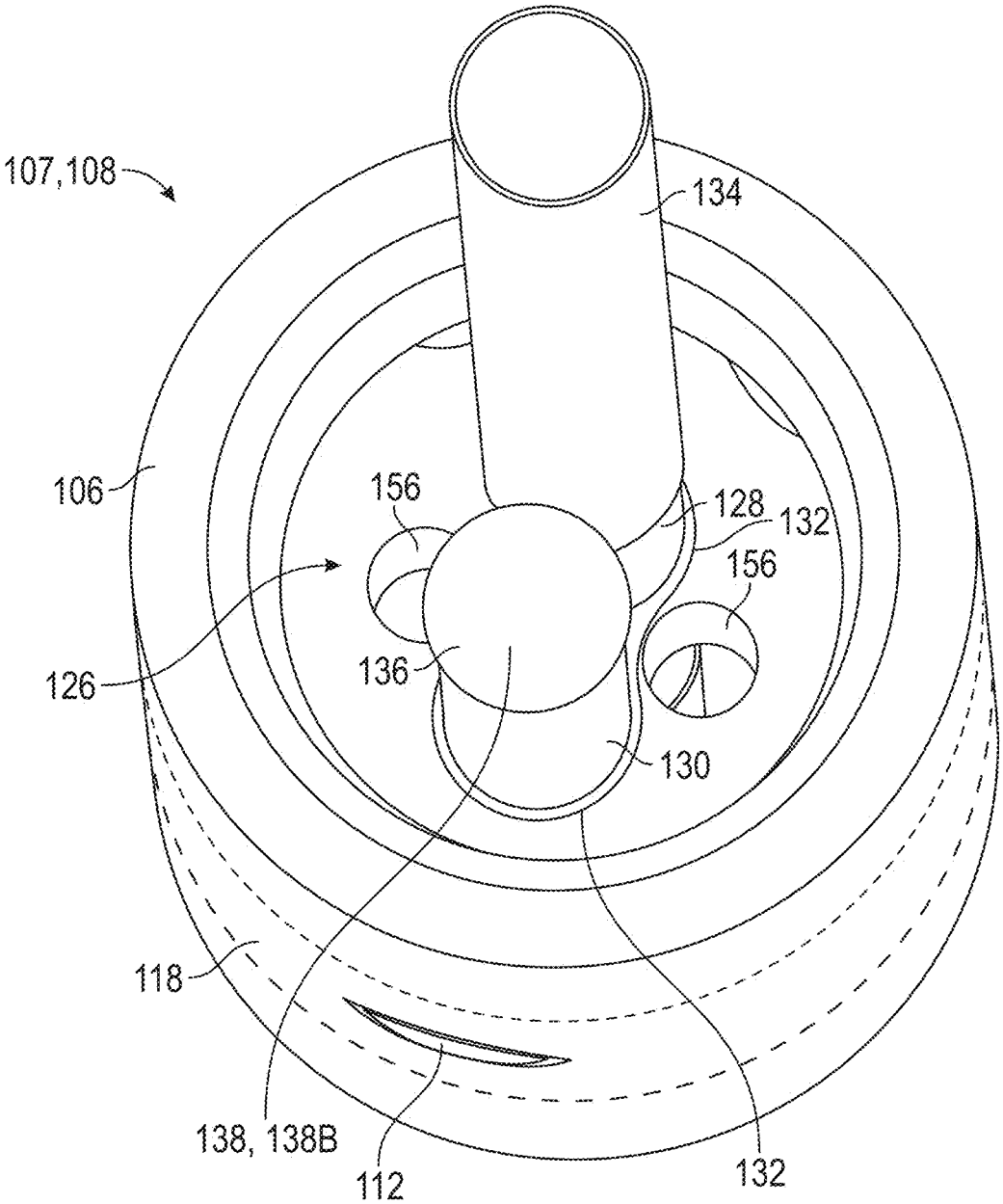
FIG. 9 is a top perspective view of the view shown in FIG. 8.
Figure 10:
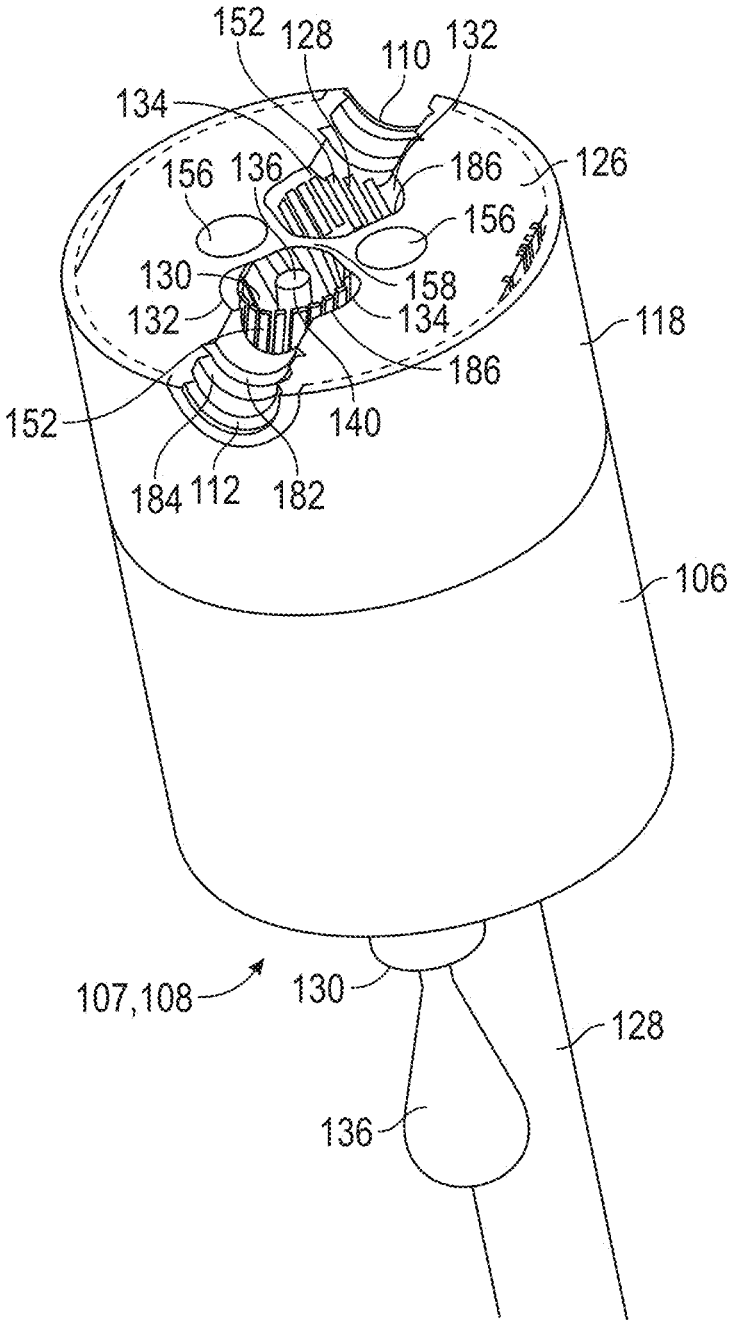
FIG. 10 is a cut-away view of the assembly shown in FIG. 8.

Included as part of the operational components are an inlet tube 128 and an outlet tube 130 are held in place by through bores 132 (see FIGS. 6, 8, and 9) in the coupling member 106. The inlet tube 128 is coupled to one or more extension tubes 134, which may be telescoping tubes as illustrated in FIG. 6. Numerous extensions 134 may be provided and coupled telescopically to a respective tube 128. The extension tubes may be extended or adjusted for the container size, specifically length of the base of the container (102, 104) from the respective end (107, 108) from which the tube 134 extends, with one of those extensions 134 on either or both ends of the tube. As noted, in one example, the extensions 134 are telescoping tubes. Further, extensions tubes may be coupled to the outlet 130 in the manner as described for the inlet tube 128. It is understood the check valve assembly 136 may be adjusted or exchanged for another check valve assembly 136 to accommodate for just a change in length of the combination of the outlet tube 130 and extension tube(s) 134.

With attention to FIGS. 1 to 10, the outlet tube 130 carries the check valve assembly 136. The check valve assembly 136 comprises a bearing pin 140 having opposite geometric shaped ends 138 separated by the bearing pin 140. The geometric ends 138 may have a number of shapes, for example a first aspect of the geometric end 138A has a tear drop or conical shape, see FIGS. 2 to 5. A second aspect of the geometric end 138B provides for a spherical or semi-spherical shape, see FIGS. 6, 7, and 9. More specifically, the bearing pin 140 is positioned collinear within the outlet tube 130, and specifically the outlet tube cavity 142 defined by the outlet tube 130, and has on each end the geometric end 138. The geometric end 138 is shaped to seat and seal a corresponding outlet tube end 144 of the outlet tube 130, see FIGS. 6 and 7. In a first embodiment of the geometric end 138A, the end 138A has a conical shape thus the geometric end 138A slides along the conical slope of the conical shape to seat and seal along the corresponding outlet tube end 144 when the geometric end 138A lowers as a result of gravitational influence. The shape of the bearing pin or rod 140 along the length of the bearing pin may be substantially linear or have a significant amplitude along the length of the bearing pin or rod 140. When the first geometric end 138A is applied the shape of the bearing pin along the length may preferably be either linear of have the amplitude as described, and the end 138A will seat and seal along the corresponding outlet tube end 144. In regard to the second aspect of the geometric end 138B, and the first aspect of the geometric end 138A, the shape of the bearing pin or rod 140 along the length of the bearing pin is important as it functions to centralize the connection of the geometric end (138, 138A, 138B) to the bearing pin or rod 140 within the tube 130. This centralization is heightened by the inclusion of corrugated sections 146 along the length of the bearing pin or rod 140, see FIG. 6. The corrugated sections 146 may be preferably proximate to the corresponding geometric ends (138, 138A, 138B). Alternatively, the corrugated sections 146 may be along the entire length of the bearing pin or rod 140 or intermittent along the length of the bearing pin or rod 140. The corrugated sections 146 of the bearing pin or rod 140 have an amplitude 148 which is substantially the outlet tube internal diameter 150. One or both of the location of the corrugated sections 146 along the length of the bearing pin or rod 140 and the relationship of the amplitude 148 and the outlet tube internal diameter 150 prevents the geometric end (138, 138A, 138B) from catching the corresponding outlet tube end 144, and specifically an edge of the corresponding outlet tube end 144, of the tube 130. As in prior art uses of a pin and end relationship, if the geometric end (138, 138A, 138B) catches or is restricted by the corresponding outlet tube end 144, and specifically an edge of the corresponding outlet tube end 144, of the tube 130 the geometric end (138, 138A, 138B) will not seat and seal the corresponding outlet tube end 144. If a seal is not provided between the geometric end (138, 138A, 138B) and the corresponding outlet tube end 144, liquid in the upper vessel (see vessel 104 in the figures) leaks through the check valve causing a malfunction in the device 100. There are many potential variations of the check valve assembly in both the geometric end 138 and the bearing pin or rod 140 which will provide sealing with the corresponding outlet tube end 144 so long as a cross-section of the geometric end 138 sealably complements the corresponding outlet tube end 144 and actuates properly facilitating the fluid flows in the device 100. These can include various shapes and mass or weights of the sealing members as well as different tube shapes or lengths. For example the relationship between a pin diameter of the bearing pin or rod 140 and an outside diameter of the geometric end 138 and the outlet tube internal diameter 150 are a 4 to 1 diameter aspect ratio. For example: the bearing pin or rod 140 diameter is 2 mm and the outside diameter of the geometric end 138 and the outlet tube internal diameter 150 is 8 mm. Additionally, the relationship between a pin diameter of the bearing pin or rod 140 and an outside diameter of the geometric end 138 and the outlet tube internal diameter 150 may be 2 to 1, 3 to 1, 5 to 1, or 6 to 1 and comprise dimensions described corresponding to such.

The inlet tube 128 is aligned with the inlet aperture 110 on the central coupling member 106. The outlet tube 130 is aligned with an outlet port on the central coupling member 106. The inlet and outlet tubes 128, 130 extend collinear through the central coupling member 106 and each have an aperture or large aperture or a series of smaller holes, slits, or other types of openings 152, see FIG. 6, created to allow the passage of fluid or vapor/smoke in one direction but limit the amount of liquid that is capable of exiting the device 100 unintentionally. The limitation of liquid exiting the device 100 unintentionally is due at least in part to the relationship of the size of the individual openings 152 to the surface tension of the liquid. The size optimally causes the liquid to arrest at the opening due to the surface tension of the liquid is higher than any force acting against the respective surface tension. This is particularly important on the inlet side, as water draining out the inlet side tends to wet combustible materials, rendering them far less combustible. The apertures 152 in the inlet or outlet tubes also serve a function to filter the vapor or product liquid being processed through the device 100 in the inlet and outlet tubes (128, 130). Further, the angled cuts of the apertures (see FIG. 6) in the tubes (128, 130) provide a means of minimizing the likelihood the relative rotational orientation of either the inlet tube 128 with respect to the inlet aperture 110 (see FIG. 8), and the outlet tube 130 with respect to the outlet/exit aperture 112 (see FIG. 8), will substantially effect flow or obstruction of flow or vapor or product liquid being processed through the device 100. Specifically, the engineered gap or opening of each aperture at the disclosed angle of the aperture 152, along with the adjacent and near apertures in proximity to the respective aperture 152 around the circumference tube (128, 130), results in a similar cross sectional area of aperture(s) 152 about the circumference of the tube (128, 130) open to flow versus obstructed regardless of the rotational position of the tube (128, 130), inlet tube 128 with respect to the inlet aperture 110 (see FIG. 8) or the outlet tube 130 with respect to the outlet/exit aperture 112 (see FIG. 8). On each tube the apertures 152 are grouped such that the aggregate extends about the circumference of the tube (128, 130). With respect to a location of the apertures along an inlet tube length of the inlet tube, between corresponding inlet tube ends 154 which define the extent of the inlet tube 128, the apertures may be located at any location along the length of the inlet tube. Preferably the apertures 152 on the inlet tube 128 are positioned proximate to a center of the length between the corresponding inlet tube ends 154. the corresponding outlet tube end 144. Similarly, with respect to a location of the apertures 152 along an outlet tube length of the outlet tube 130, between the corresponding outlet tube ends 144 which define the extent of the outlet tube 130, the apertures may be located at any location along the length of the outlet tube 130. Preferably the apertures 152 on the outlet tube 130 are positioned proximate to a center of the length between the corresponding outlet tube ends 144.

The two tubes (128, 130) may be identical in nature to allow for a high level of interchangeability as well as an agnostic orientation. For example, as previously disclosed an entire band of apertures 152 (small or large) may be provided around the circumference of the tube (128, 130) so that the rotational orientation of the tube (128, 130) with respect to the respective is inlet aperture 110 (see FIG. 8) for the inlet tube 128, and outlet/exit aperture 112 (see FIG. 8) for the outlet tube 130, is agnostic. However, it is contemplated that the two tubes may be specifically designed, shaped, or configured for one or either location (inlet or outlet).

Two drain holes 156 are also provided and extend through the separator plug 126. The drain holes 156 are perpendicular to the through bores 132, which respectively house the inlet tube and the outlet tube 130, and offset from the cross sectional center 158 of the separator plug 126 (see FIG. 8). The drain holes 156 provide the access channels for movement of liquid from the upper vessel (vessel 104 in the figures) to the lower vessel (vessel 102 in the figures) when vapor or product enters the upper vessel from the inlet tube 128. The drain holes 156 are placed in a location to help ensure adequate flow of the fluid from the upper vessel (vessel 104 ion the figures) to the lower vessel (vessel 102 in the figures), and are also a diameter to minimize the likelihood of gases from the lower reservoir percolating in the opposite direction of fluid flow. The number of drain ports may be increased or decreased based upon volume of vessels and viscosity of fluid.

The central coupling member 106 comprises the shell or housing 118. The shell or housing 118 may be composed of any suitable material for the purposes provided. In one or more examples of aspects of the device 100, the shell or housing 118 has a degree of elasticity on at least its ends to facilitate the connection of vessels 102, 104 thereto and also has a degree of rigidity to allow the suction powered siphon device to stand and hold two opposing vessels 102, 104 in a consistent position. This housing has the necessary geometry on its opposing ends to fit a variety of different vessel options such as, but not limited to beer bottles, wine bottles, soda bottles, and the like.

As indicated, the coupling member 106, and specifically separator 126, includes through bores 132, which are geometry, e.g., shaped areas or receptors, configured for the inlet and outlet tubes 128, 130. The housing also includes an inlet aperture 110 extending from a sidewall to the inlet receptor/inlet tube 128 and an outlet aperture 112 extending from a sidewall to the outlet receptor/outlet tube 130. The inlet aperture 110 may be shaped with a geometry that mates with a bowl, a joint, a vaporizer, or other like device. The outlet aperture 112 may be shaped with a geometry that mates with a smoke or vapor delivery mechanism, such as but not limited to a whip, and may have a joint therebetween for accomplishing the attachment of the whip. The two apertures are not interconnected between each other. Instead, each one is connected to its own inlet or outlet port respectively. The two apertures may have the same geometry so that the user may select either port as the inlet or outlet when assembling the device (as discussed in further detail below).

The coupling member 106 has the inlet aperture 110, and accompanying inlet port providing access to the inlet aperture 110, that allows vapor, smoke, product liquid etc., to flow into the device 100, and in particular into the inlet tube 128 and into to the top vessel (vessel 104 in the figures). The device inlet component 160 of the device 100 thus comprises an inlet tube 128 of a predetermined dimension, having the apertures 152 to take advantage of amongst other things water's surface tension, i.e. the liquid surface tension which reduces the likelihood of backflow into the inlet tube 128, and the inlet aperture 110, and accompanying inlet port providing access to the inlet aperture 110. The coupling member 106 also has the outlet aperture 112, and an accompanying outlet port providing access to the outlet aperture 112, to direct the flow of vapor, smoke, liquid product, etc., out of the device 100 and into a smoking chamber or vessel, a mouthpiece or any sort of attachment that may be secured to the coupling device. The outlet port may include an outlet accessory which is one tube of a predetermined dimension and one port, or in one example, perforated slots similar to the inlet component. The device outlet component 162 of the device 100 thus comprises an outlet tube 130 of a predetermined dimension, having the apertures 152 to take advantage of amongst other things water's surface tension, i.e. the liquid surface tension which reduces the likelihood of flow into the outlet aperture 112 from the outlet tube 128, and the outlet aperture 112, and accompanying outlet port providing an exit from the outlet aperture 112 and the coupling member 106.

The location of each of the apertures and drain ports can be adjusted provided the system remains in balance. It is important that the aperture (110, 112) facilitate flow of gas, both into the inlet and out of the outlet tube. Although this does not require the manifold visible, in figure eight, if there is not some additional space surrounding the apertures on both the inlet and outlet tubes flow may be restricted or cut off entirely if the inlet and outlet tubes are not positioned rotationally, correct.

The coupling member 106 further comprises a first coupling section 168 between the separator 126 and the first end 107. The coupling member 106 further comprises a second coupling section 164 between the separator 126 and the second end 108. The first coupling section 168 and first end 107, and the second coupling member 164 and the second end 108, is multifunctional. The coupling member 106, which includes the stated features, is made from an elastomeric material. As an elastomeric material, for example silicone, rubber, a rubberized polymer, or another elastomeric material, the coupling member 106 can expand or constrict, or both to facilitate a sealed connection with a vessel (102, 104). A vessel (102, 104) can sealably attach to the outer circumference 170 of either or both of the first coupling section 168 and the second coupling section 164 due the elastomeric properties of the coupling member 106.

The result is the outer circumference 170 compresses to conform to the vessel inner circumference 172 of the respective vessel (102, 104) providing for the sealed attachment. Similarly, as illustrated in the figures, a vessel (102, 104) can sealably attach to the inner circumference 174 of either or both of the first coupling section 168 and the second coupling section 164 due the elastomeric properties of the coupling member 106. The result is the inner circumference 174 expands, and compresses according to the geometry of the vessel, to conform to the vessel outer circumference 176 of the respective vessel (102, 104) providing for the sealed attachment. Both internal and external geometries of the coupling member 106, for example the internal and external geometries of the first coupling section 168 and the second coupling section 164, further facilitate creating a seal, as well as facilitating retention of the vessel to the coupling member 106. Examples of such internal geometries include ribs or internal O-rings 169. It is also contemplated that the central coupling member 106 may be constructed of a rigid material such as glass or metal and have a tapered fitting on either end to enable it to mate with tapered vessels such as but not limited to lab glass. This rigid construction may have tapered fittings on either end as well as any or all of the other apertures or attachment points where desirable for coupling components to enable those or any other suitable components to mate with tapered fittings on vessels such as but not limited to lab glass as well as the inlet or outlet tubes, drain modulating accessories, inlet or outlet accessories such as burn chambers or bowls and thermal extraction devices, vaporizers or couplings for routing various other gasses or fluids to or from the device.

The desired bowl 114 or other smoking accessory may be attached to the inlet aperture 110. A delivery device, such as a whip 116, may likewise be attached to the outlet aperture 112. Uniquely, the assembly is designed to be assembled and disassembled, allowing the device to be easily kitted and transported as well as disassembled for cleaning.

Additionally, structure of the ends (107, 108) of the coupling member 106 seal the vessels by compression sealing, the structure is incorporated on the inner circumference 174 and/or the outer circumference 170 against either the interior circumference 172 or the outer circumference 176 of the vessel. The structure may be for example an O-ring. As an example, the inner circumference of the sections (164, 168) comprises at least one O-ring 178, preferably two O-rings, for sealed connection with the vessel outer circumference 176. The dimensions of the coupling geometries are dependent on the mating geometry of the vessels intended for connection to the central coupling member. It is intended to be understood that the description of an inner circumference and outer circumference of the coupling member 106 is transferable to an inner geometry and outer geometry of the coupling member in order to accommodate vessels of various geometries and applications, for example narrow vessels in laboratory applications. Further it is understood other materials may be applied in the construction of the coupling member 106. For example, glass components may be applied for construction of the coupling member for laboratory use. In this embodiment, the central coupling member 106 couples to the vessels via a tapered ground glass, or other suitable geometry, which can be used or is used in laboratory settings to meet with laboratory glassware. The use of additional means of mechanically retaining the vessels (102, 104) to the central coupling member 106 can be applied about the sections (164, 168).

Various vessels 102, 104 are suitable for use with the siphon powered suction device 100 assembly. With that, characteristics of suitable vessels include the ability to contain a fluid and a sidewall rigid enough to withstand some level of vacuum. Suitable examples include, but are not limited to, beer bottles, soda bottles, wine bottles, many types of laboratory glass and the like. However, any bottle or container having the above-described characteristics would be acceptable for use with the siphon powered suction device 100 described herein and the coupling member 106 dimension may be adjusted to mate therewith.

The coupling member 106 can comprise an outer housing 180, such as a cowling or cover, for stiffness, branding, or other purposes. An outer structural component, such as an aluminum cowling, surrounding the central coupling member 106 may also include an attachment for a mount or stand 208, see FIGS. 12A-12D, and may be rotatable thereon.

The apertures (110, 112) have several key attributes. They connect the inlet and outlet accessories to the central coupling member 106. This is accomplished via the elastomeric nature of the material comprising the coupling member 106 in conjunction, with a molded in one-piece, mono-lithic, construction of the coupling member 106, which helps facilitate a more slip resistant mechanical connection. With that the apertures (110, 112) are molded to comprise circumferential grooves 182 and ridges 184 along the length of the apertures (100, 112). These grooves 182 and ridges 184 act a s negatives to the geometries of the accessories inserted into the apertures (110, 112). Thus, the combination of the grooves 182 and ridges 184 further act to anchor the accessory into the aperture (110, 112). Additionally, along the through bores 132 and proximate to the apertures (110, 112) engineered spaces or gaps, manifold, 186 surround portion of the inlet and outlet tubes (128, 130), preferably about at least part of the apertures 152 of the tubes (128, 130). The manifolds 186 function to spread the incoming or outgoing vapor, gasses, or product liquid around a larger portion of the inlet or outlet tube (128, 130), helping to ensure an adequate cross-section of the aperture in the inlet or outlet tubes are open for flow purposes. Specifically, the manifold provides for 270 degree circumferential concentric coverage of the apertures 152 on the respective tube (128, 130). Alternatively, the manifold may provide for more than 20 degree or less than 270 degree circumferential concentric coverage of the apertures 152 on the respective tube (128, 130).

As stated, vapor and fluid flow are controlled by one or more valves. In one example, two check valves 136 are positioned to cover and/or open the correct port when the device 100 is rotated 180 degrees. Fluid flows are controlled through the check valve 136 that remains open to the lower vessel 104, providing an exit port for the volume of gas/vapor in the lower vessel 104 to be displaced by liquid flowing from the upper vessel 102 to the lower vessel 104, around the closed check valve through the drain ports 156 into the lower vessel 104. The check valve assembly 136 remains closed to the upper vessel 102 to prevent fluid from entering the check valve assembly and flowing out the exit port, encouraging the fluid to flow down the drain hole or holes 156 to provide the displacement necessary to operate the device.

The inlet tubes 128 are intended to reside near the bottom inside surface of each of the vessels 102, 104 attached to the coupling device 106. This provides several useful advantages, such as but not limited to the tube in the lower vessel upon immersion by the working fluid is quickly sealed once fluid has begun to flow from the upper vessel 102 to the lower vessel 104 and reaches a level above the opening of the tube in the lower vessel 104. This prevents any of the volume of air/gas/smoke or vapor in the lower vessel 104 from flowing up the inlet tube 128, to the upper vessel 102. While the inlet and outlet tubes 128, 130 are described as being mounted collinear with each other, it is contemplated that the telescoping portion or the inlet portion may be provided at a slight angle, given the geometry of the vessel. In the event that the inlet tube 128 fits flush with the vessel 102, 104, the tube or extension may have holes or apertures in the ends or some sort of geometry to reduce the likelihood of creating an unintentional seal.

The construction of the device 100 from an elastomeric material, for example silicone, in a single one-piece, monolithic construction further enables functionality with fewer parts, as the elastomeric nature of the material allows for coupling of the vessels (102, 104), as well as inlet aperture 110 accessories, and outlet aperture 112 accessories, without the need for additional means to retain the accessories in place, and the retained positioning of the inlet tube 128 and the outlet tube 130. Combining all of these above attributes and features into a single molded elastomeric device 100 is a significant simplification of such devices, which in prior art have required multiple components. Further, the use of a gravity actuated double ended check valve with a central output provides a controlled simplification of the flow of vapor, gas, product fluid and non-product fluid transferred between the vessels and their corresponding inlet and outlet apertures.

A kit may be provided including the various components necessary for a user to assemble the siphon powered suction device 100. The kit may include a package containing a central coupling member 106 or housing, two tubes having apertures (i.c., the inlet and outlet tubes 128, 130), one or more extensions 134 or telescoping tubes, a check valve with at least one end that is separable for assembly or alternatively the outlet tube 130 may be provided pre-assembled with the check valve therein, a bowl 114, and a whip 134 with corresponding adapter or joint to attach to the central coupling member 106. Two vessels 102, 104 may be optionally included in the kit; alternatively, the user may supply his or her own vessels.

The kit may be assembled by a variety of processes. One example is described as follows. A user may insert the inlet tube 128 and the outlet tube 130 into the through bores 132 of the central coupling member 106. The user inserts the tubes 128, 130 until the aperture(s) in the tubes align with the respective inlet aperture 110 and outlet aperture 112 in the central coupling member 106. The extension tube(s) 134 are then attached to the inlet tube 128. A vessel 102, 104 is then coupled to each end of the central coupling member 106 connecting, or seating, the end of the member 106 over the top of the vessel 102, 104 so that it is secured in place (sec FIGS. 6 and 7) or compressing the member 106 into the vessel to the inlet aperture 110. A delivery device, such as a whip 116, may likewise be attached to the outlet aperture 112. The combination of the above couples and creates a sealed transfer from the inlet aperture 110, through the device, out the outlet aperture 112, and to a delivery device.

With attention to FIGS. 1 to 10, in operation, similar to an hourglass, when the siphon powered suction device 100 assembly is turned over, water or any other liquid contained within the assembly will drain from one vessel 102 through the central coupling member 106 to the other vessel 104 (i.c., from the top to the bottom as a result of gravity). This movement of liquid, in turn, creates a suction that will transfer vapor/smoke from an attached bowl 114 or joint or vaporizer or other apparatus into the space in the vessel 102 opened by the displaced water. Turning the assembly over once again will repeat these actions but force the vapor, smoke, acrosol, other gas, or product liquid previously drawn into the vessel 102 (now 104) to exit the device assembly by entering the outlet tube, transferring through the outlet aperture 112 and associated exit port.

In further detail, the process of draining the fluid from the upper vessel through the flow channels in the coupling device, a drop in pressure is created which encourages flow in a particular direction from the inlet aperture 110, to a into and up the inlet tube 128 of the coupling device 100 into the upper chamber or vessel (vessel 104 in the figures). As the fluid is displaced from the upper chamber or vessel, from the initial rotation of the device prior to and concurrent with the encouragement of flow of vapor, gas, or product liquid into the inlet aperture 110, to the lower chamber or vessel (vessel 102 in the figures) and the fluid accumulates in the lower chamber or vessel. As a result, the volume of vapor, gas, or product liquid is displaced from the lower chamber, encouraging it to enter the outlet tube 130 and subsequently enter the outlet aperture 112 and exit the entire device 100 through the port associated with the outlet aperture 112. When vapor enters the top vessel (vessel 104 in the figures), the inlet tube in the respective vessel is open and the exit tube 130 is sealably closed with the check valve in the respective vessel. As a result, vapor, gasses, smoke, and/or product liquid flow freely into the respective upper vessel from the inlet tube 128. Once the device 100 is rotated 180 degrees from the start position, the respective vessel changes position to the lower position (vessel 102 in the figures). As a result, the exit tube 130 in the respective vessel (now in the vessel 102 position in the figures) will open and the opposite end 144 of the outlet tube (in the vessel now in the upper vessel position) will close. Thus, vapor, smoke, gas, or product liquid in the respective vessel (located in the position as vessel 102 in the figures) flows or is forced into the now open outlet tube 130 into the outlet aperture and out of the device 100.

With that, the process of cleaning the device as compared to the prior art is simplified. It is possible to clean the entire device by pouring a small amount of solvent into one vessel (102, 104). Removing the inlet tube 128, the outlet tube 130, the extension(s) 134, and the check valve 136. Placing the inlet tube 128, the outlet tube 130, the extension(s) 134, and the check valve 136 into the opposite vessel (102, 104). Plugging the apertures 110 and 112 with one's fingers or some other means. Slowly rocking the device 100 back and forth to facilitate flow of the solvent through and around the inlet tube 128, the outlet tube 130, the extension(s) 134, and the check valve 136. Placing the inlet tube 128, the outlet tube 130, the extension(s) 134, and the check valve 136 and the surfaces of the monolithic construction of the coupling member 106, which includes but is not limited to the through bores 132, drain holes 156, inlet aperture 110 and associated inlet port, outlet aperture 112 and associated outlet port, and the separator plug 126. Where the check valve is not removed from the outlet tube 130, the cleaning process is ideally done in a process that minimizes the seating or sealing of the check valve so the solvent can flow normally through the inlet tube from one vessel to the other but also through the check valve assembly as a slow rocking rotation does not seat the check valve.

Also, it is possible to perform a simplified cleaning by only removing the inlet and outlet accessories, plugging their respective apertures and using a cleaning solution poured into one vessel. The cleaning is performed with all internal components in place and as above when the assembly is slowly rocked the cleaning solution will wash all surfaces of all components internal to the apparatus.

With that, there are several unique aspects to the operation of the device 100. Firstly is the use of commonly available vessels (102, 104) in a gravity siphon system, without modification of the vessels (102, 104). Second is the simplification of the device 100 its parts, and its operation for not only use, but also transport, disassembly and cleaning. Further, the device 100 may be used in selective thermal extraction, where compounds are distilled based upon the temperature of the thermal extraction chamber and or the solution in the device 100. The compound sought evaporates at a specified temperature and is displaced out of the device 100 as described above. This displacement can be facilitated via applying suction and allowing ambient air to displace the evaporated compounds from the sample, or can be done by using a pressurize gas of any nature, sometimes of a purified form to minimize contamination or oxidation of the sample, and or any thermally extracted compounds. Further, density based distillation may be applied as well where the mass of the geometric ends 138 is varied to allow actuation of the specified amounts of the vapor, gas, smoke, or product liquid based upon the relationship of the density of the product to the mass of the geometric ends 138.

With attention to FIGS. 11A to 11D, a second aspect of the bowl is described herein. The second aspect of the bowl 114A has at least one feature of the bowl 114. The second aspect of the bowl 114A comprises an aperture attachment 188. The aperture attachment 188 scalably inserts into the inlet aperture 110. The end of the aperture attachment 188 opposite that which enters the inlet aperture 110 is sheathed into a collar 190. A hollow axle 192 is positioned longitudinally through the aperture attachment 188 and the collar 190 and exits the collar 190 opposite the aperture attachment 188. A bearing 194 is positioned about the axle 192 and rests in the housing opposite the aperture attachment 188. A plurality of washers 196, preferably three washers 196, are positioned at the end of the axle 192 opposite the aperture attachment 188. The described assembly is then inserted, specifically the washers 196 and respective portion of the axle 192, into the bowl transfer housing 198. Attached to housing 198 and predominantly perpendicular to the collar 190 is a product bowl 200. Opposite the product bowl 200 and predominantly perpendicular to the collar 190 is a stopper 202. The stopper 202 closes an open end of the housing 198 opposite the product bowl 200. Housed within the housing 198 and resting atop the stopper 202 are a plurality of spheres, preferably two spheres, 204. The spheres are weighted and act as a counterbalance. The combination of the bearing 194, axle 192, and washers 196 provide for rotation of the housing 198 and bowl 200. Specifically, when the device 100 is rotated 180 degrees, the bearing 194, axle 192, and washers 196 provide for rotation of the housing 198 and bowl 200 With that, the spheres 204 counter the rotation to ensure the bowl remains upright during and after rotation of the device 100.

Figure 11A:
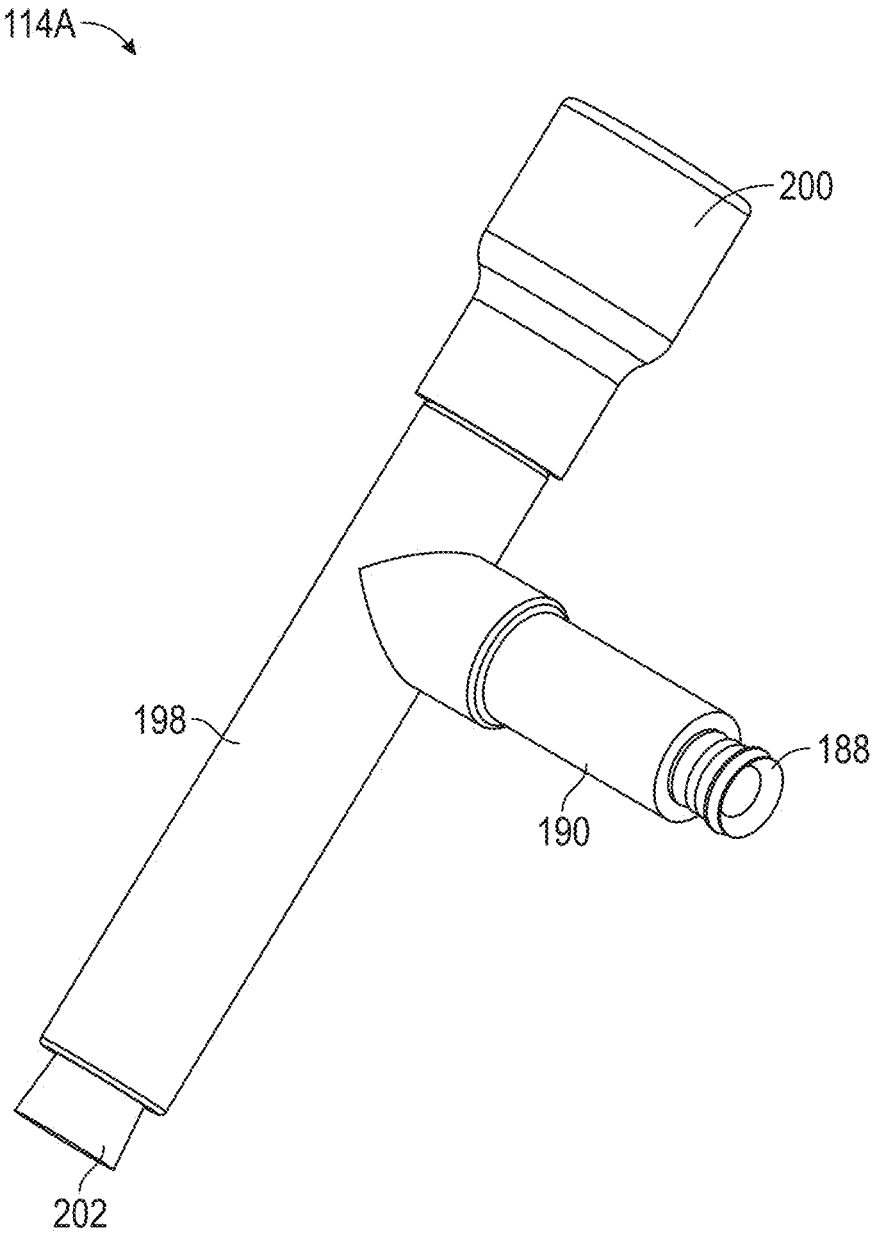
FIG. 11A is a perspective view of a second aspect of a bowl.
Figure 11B:
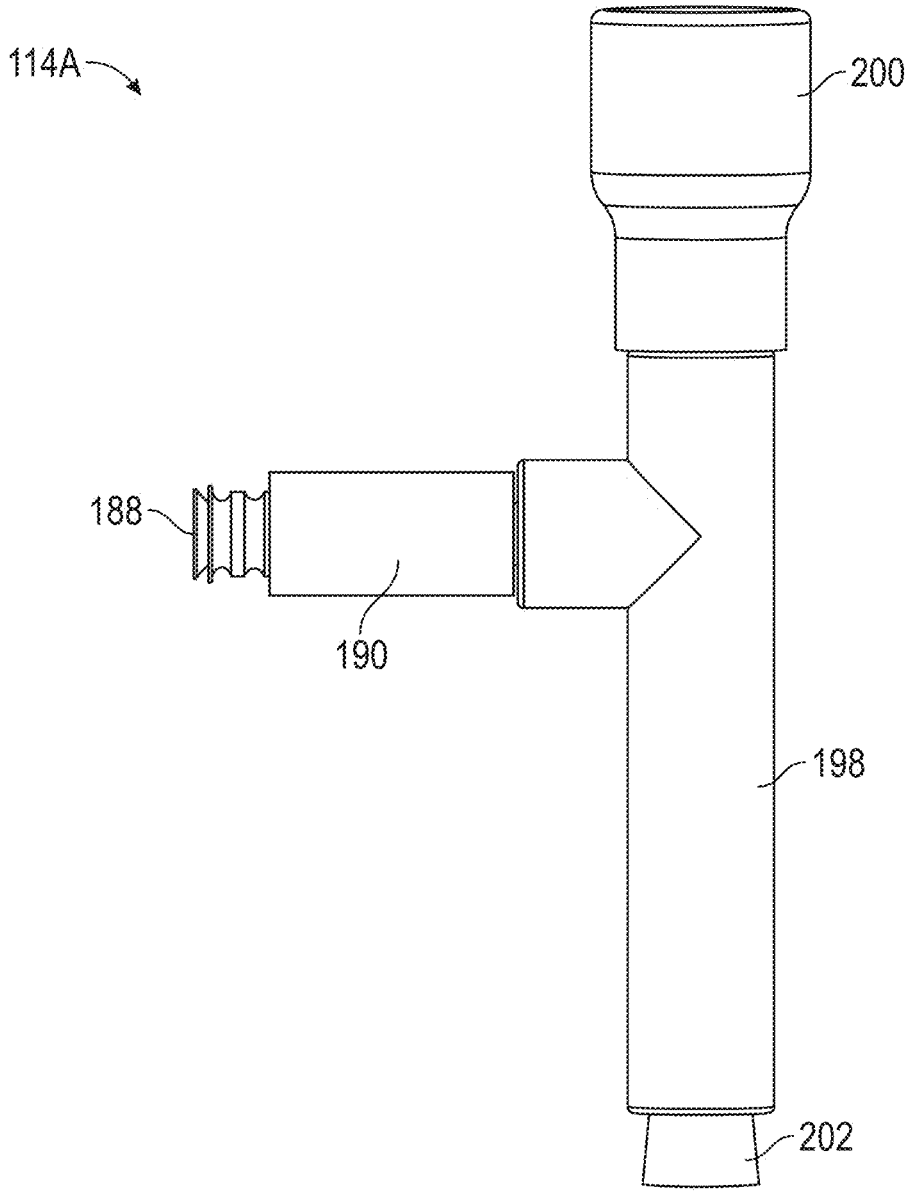
FIG. 11B is a side view of the bowl in FIG. 11A.
Figure 11C:
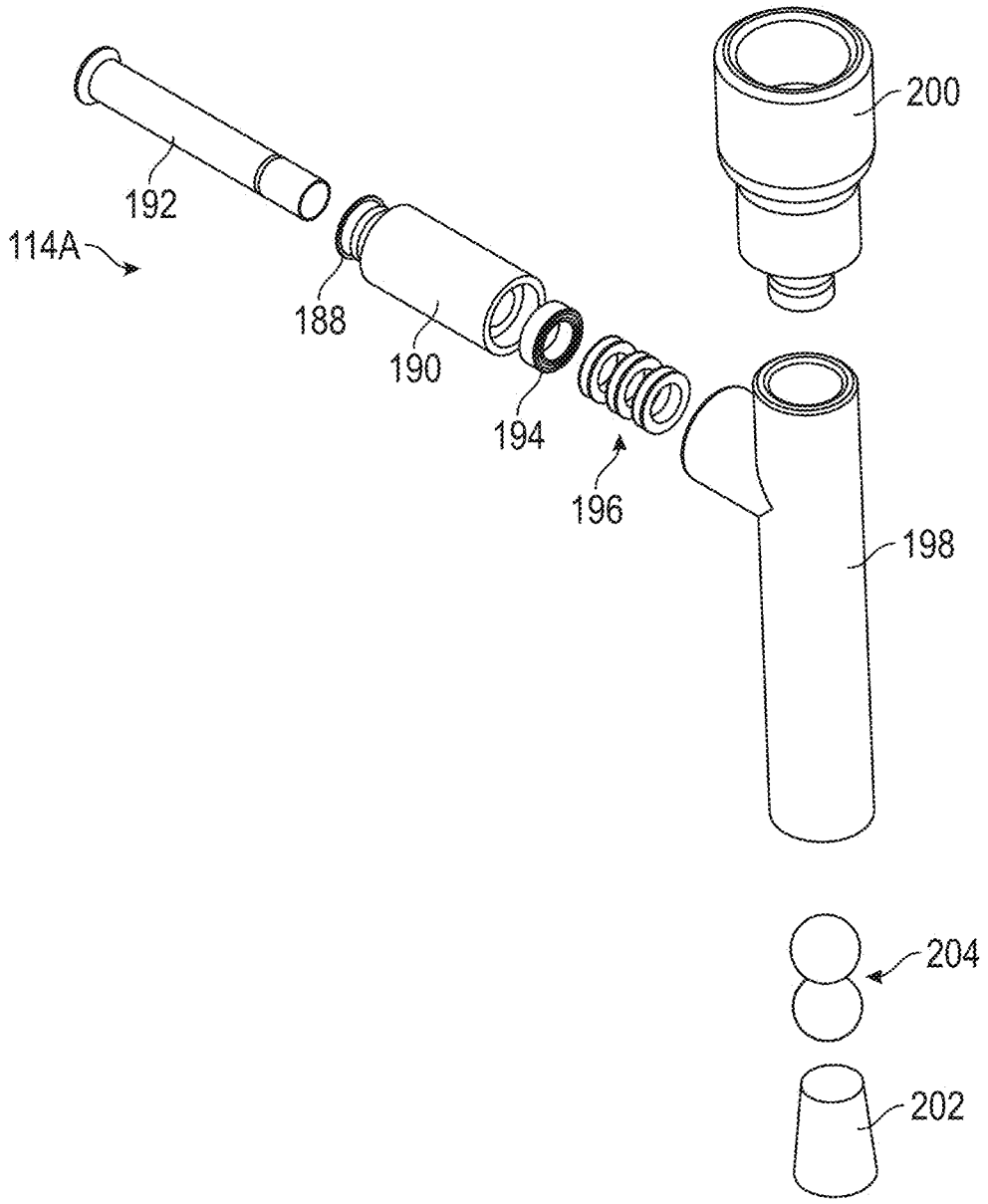
FIG. 11C is an exploded perspective view of the bowl in FIG. 11A.
Figure 11D:
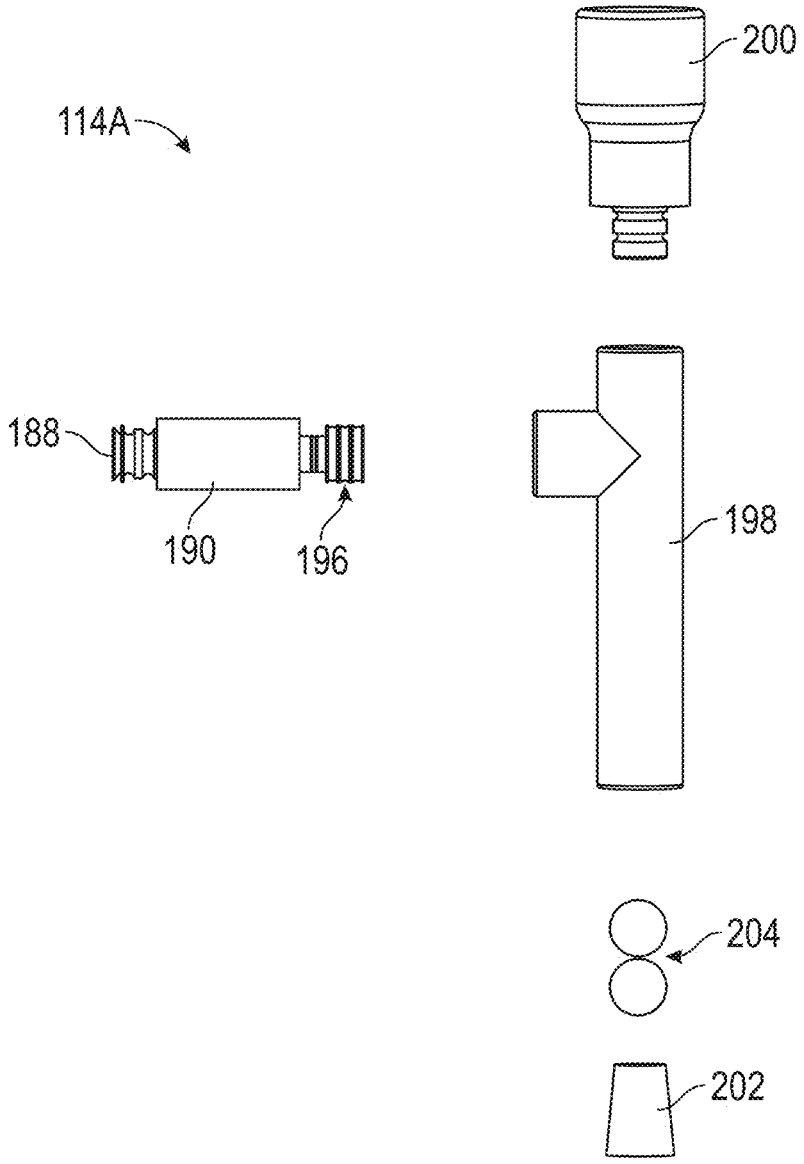
FIG. 11D is an exploded side view of the bowl in FIG. 11A.
Figure 11E:
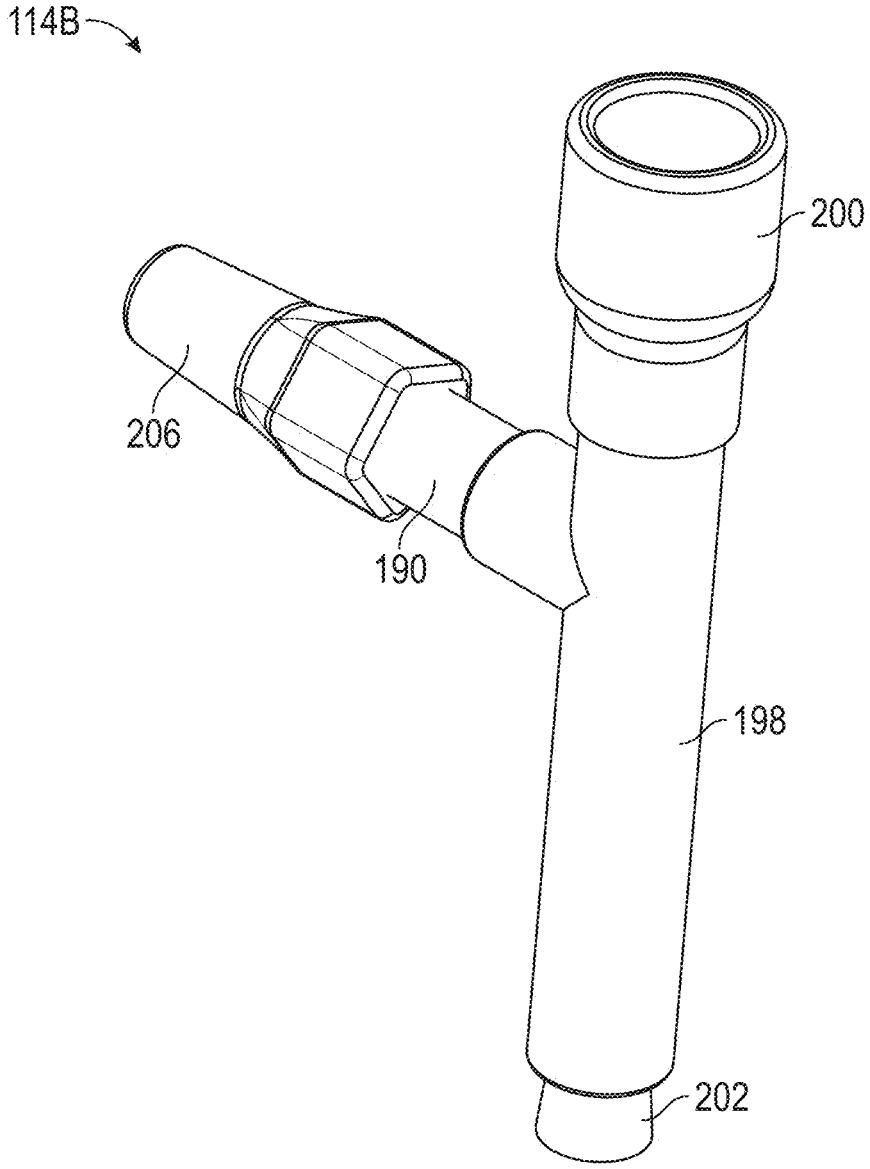
FIG. 11E is a perspective view of a third aspect of a bowl.

With attention to FIG. 11E, a third aspect of the bowl 114B is described herein. The third aspect of the bowl 114B has at least one feature of the bowl 114 and the second aspect off the bowl 114A. With that the bowl 114B has a mouthpiece 206 to allow use if the third aspect of the bowl 114B without the device 100. The mouthpiece 206 is at in line with the collar 190 and aperture attachment 188 at and in connection with the aperture attachment 188.

Figure 12A:
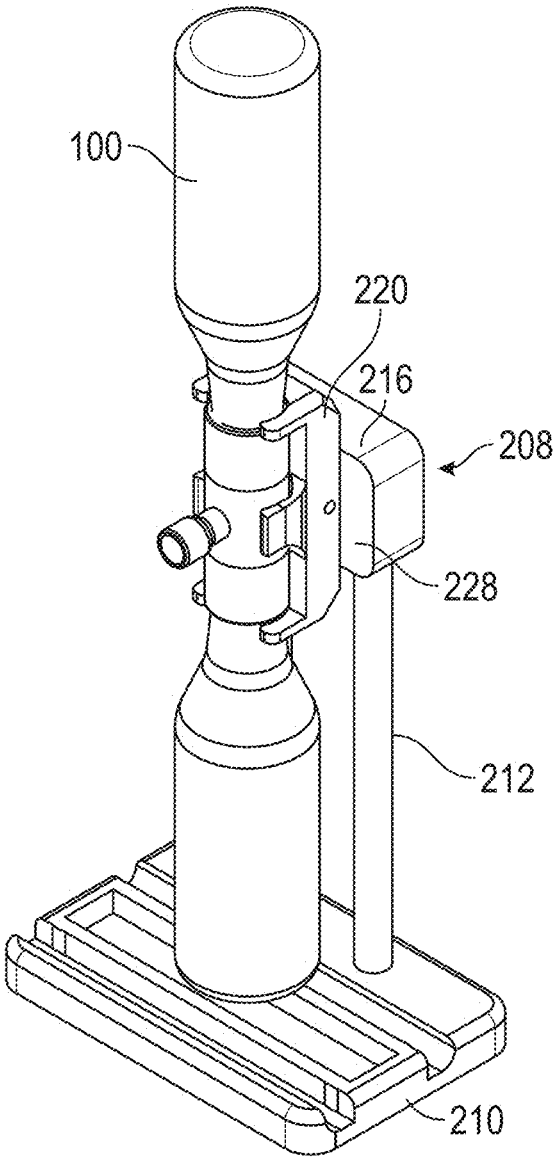
FIG. 12A is a perspective view of a support structure for the siphon powered suction device, with the siphon powered suction device in rotational communication with a first side of the support structure.
Figure 12B:
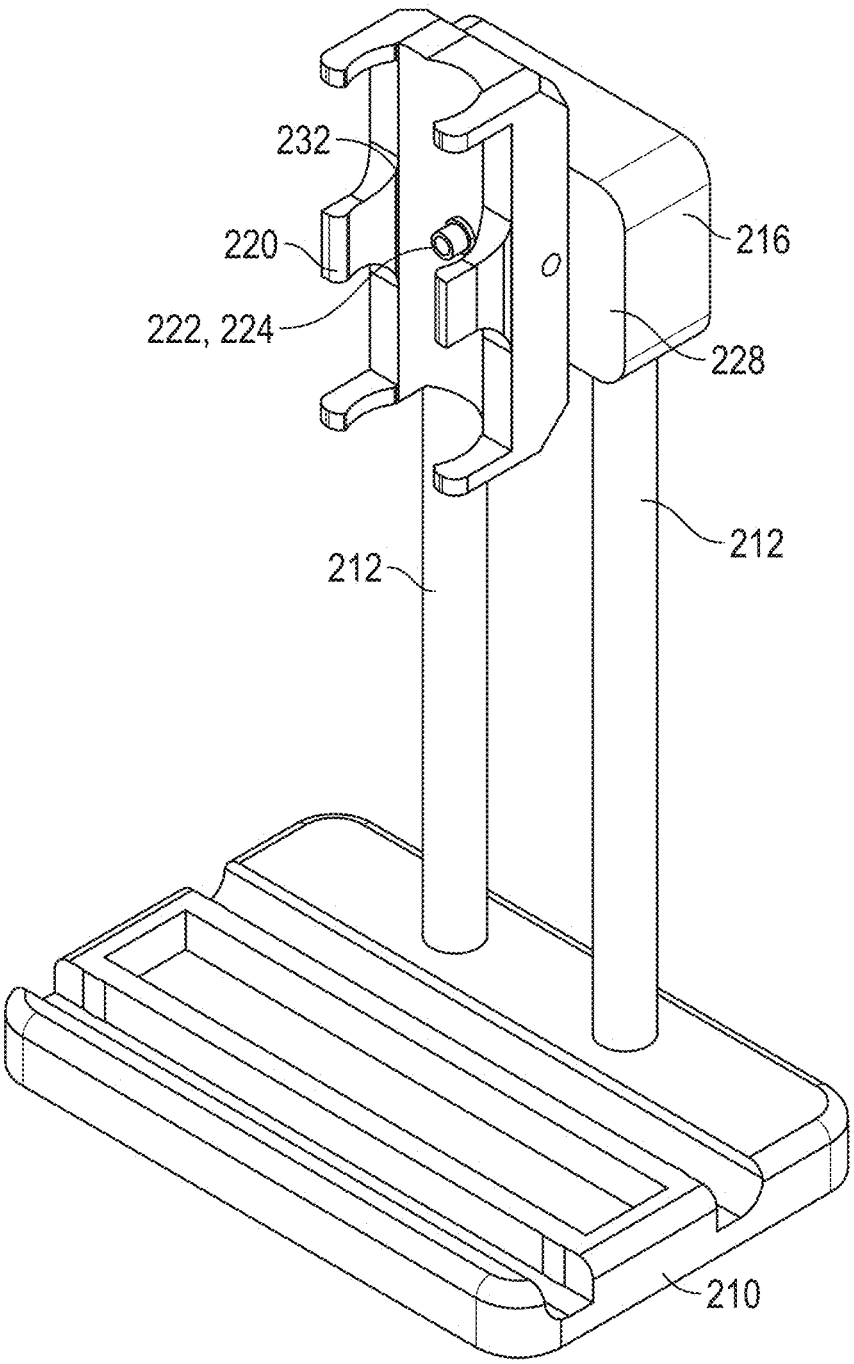
FIG. 12B is a perspective view of the support structure in FIG. 12A.
Figure 12C:
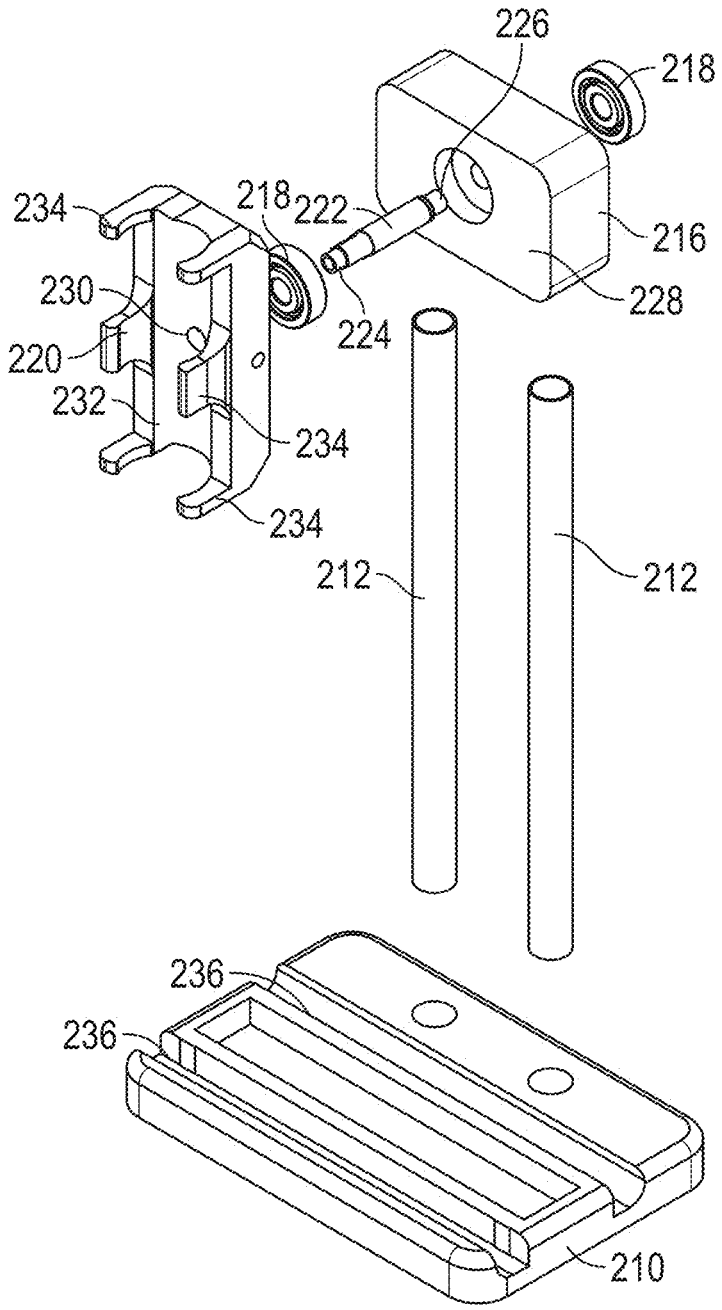
FIG. 12C is an exploded perspective view of the support structure in FIG. 12A.

With attention to FIGS. 12A to 12D, a support structure 208 is described herein. The support structure is used to rotate the device 100 180 degrees as previously described and removing the need for continued human support of the device 100. As illustrated in FIGS. 12A-12C, the support structure 208 comprises a support base 210. At least one, preferably two, rods 212 extend from the base 210. The rods 212 are preferably removably mounted in recesses 214 in the base 210. A rotation housing 216. The housing 216 provides multiple purposes. The housing 216 includes dual bearings 218 that provide for rotation of a device holder 220. The device holder 220 secures the device 100 for rotation and operation of the device 100. The bearings 218 may be housed on, or recessed in, opposing sides of the housing 218, with one of such sides in communication with the device holder 220 on a first side 226 of the housing 216. The bearings 218 alternatively may be positioned in the housing 216 adjacent one another absent a divider of spacer between the bearings 218. The housing 216 has an outlet accessory 222 which extends from the first side of the housing 228 with a first end of the outlet accessory 224 extending from the first side 228, and through the housing through the bearings 218 in the housing 216. A second end of the outlet accessory 226 extends from a second side of the housing opposite the first side 228. The first end 224 traverses through a device holder through port 230 of the device holder 220 such the first end 224 extends into the cradle 232 of the device holder 220 where the device 100 is to be positioned. The first end sealably inserts into the inlet aperture 110, see FIGS. 1-10, as previously described. The outlet accessory 222 comprises the first end 224 extending towards and sheathing over a portion of the second end 226. This allows for rotation of the first end 224 with the bearings 218 providing for the rotation while keeping the second end stationary. Rotation of the device 100 housed in the cradle 232 results in the rotation of the first end 224 via the bearings while the second end 226 remains stationary. The second end 226 may have an accessory such a whip attached to it. Thus the operation of the device 100 as has been described results in fluid transfer of the vapor, gas, smoke or product liquid from the device, through the accessory 22, and out the second end 226. With that, the cradle 232 comprises multiple appendages 234 which operate to keep the device 100 stationary through pressure.

As illustrated in FIG. 12C, the support structure 208 is easily compartmentalized for cleaning. This can be done by removing the cradle. Removing the bearings, and removing the accessory 222. Unlike the prior art, each can be completed with little or no tooling.

Figure 12D:
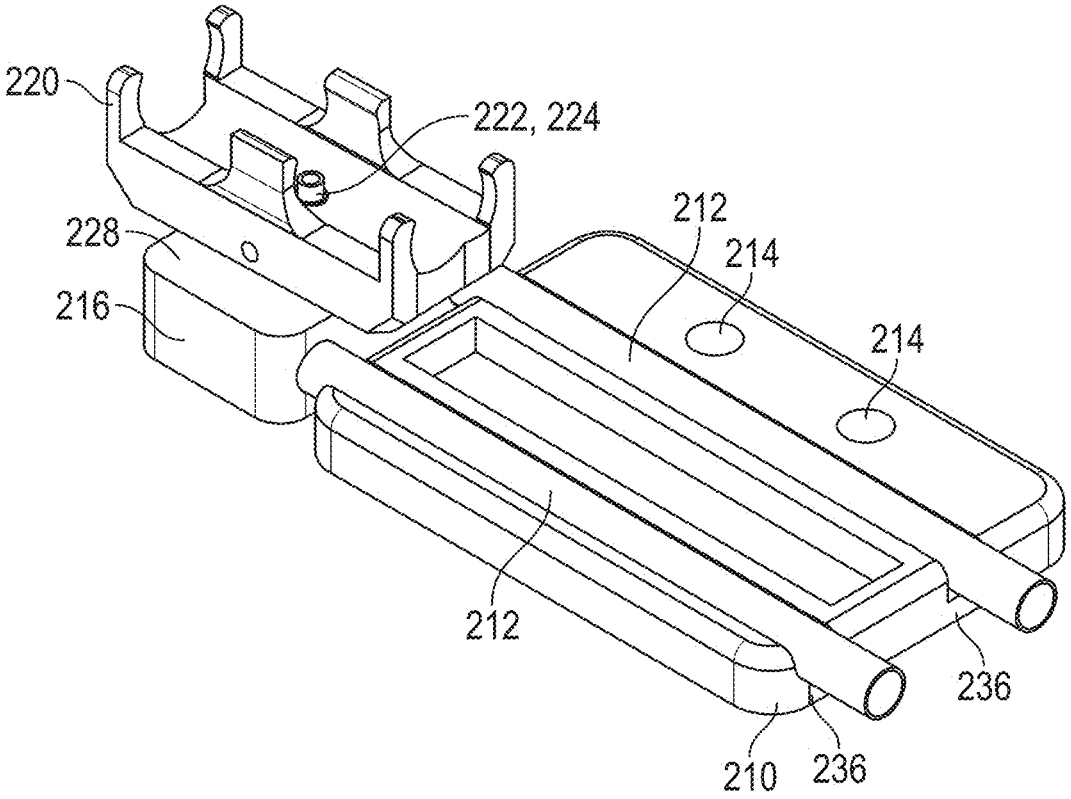
FIG. 12D is a perspective view of the support structure in a compartmentalized storage orientation.

With attention to FIG. 12D, the support structure 208 is easily compartmentalized for storage. The rods 212 are removed from the base and laid respectively in grooves 236 extending a length of the base 210.

The siphon powered suction device described herein has various advantages, examples of which are described below. One of skill in the art would understand that this list is not exhaustive and various other advantages may also be realized by the device and/or its various components as described herein:

- Portable design when assembled, improved portability with carrying case when unassembled, only requires glassware;
- Easy to disassemble, clean, and reassemble for use;
- No rotary valve;
- Compatible with various bottle sizes and glassware and types of glassware (including non-glass and glass items);
- Water filtration of vapor/smoke to reduce inhaled carcinogens and other toxins;

Enhanced smoking experience that "pushes" vapor/smoke rather than the user inhaling same;

Safe design when compared to other DIY gravity filtration devices that use plastic bottles or receptacles;

Easy to use design that requires only the assembly of the device, addition of glassware, heating of material, and inversion or rotation of the assembly;

Potential to expand into other industries such as the smoking of/infusion of drinks and/or food;

Affordable cost compared to known products available on the market; and

Compatible with thermal extraction devices and concentrate materials.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

What is claimed is:

1. A siphon powered suction device for suctioning from a first vessel to a second vessel, the siphon powered suction device comprising:

a central member having an inlet, an outlet, a first cavity with a first opening to receive the first vessel, and a second cavity with a second opening to receive the second vessel;

a check valve assembly biased open as to the outlet; and the central member further having an elastomeric mechanism to removeably and securely couple the first vessel and the second vessel in the first cavity and the second cavity, respectively, of the central member.

2. The siphon powered suction device of claim 1, wherein the inlet comprises an inlet aperture and an inlet tube, with the inlet aperture molded into the central member and the inlet tube positioned substantially orthogonal to the inlet aperture; and wherein the outlet comprises an outlet aperture and an outlet tube, with the outlet aperture molded into the central member and the outlet tube positioned substantially orthogonal to the outlet aperture.

3. The siphon powered suction device of claim 2, wherein the central member has a separator plug disposed between the first cavity and the second cavity and positioned at least substantially orthogonal to the inlet and the outlet, with the separator plug housing the inlet aperture and the outlet aperture.

4. The siphon powered suction device of claim 3, wherein the inlet tube and the outlet tube extend substantially parallel to another through the separator plug and extend beyond the central member at the first opening and the second opening.

5. The siphon powered suction device of claim 2, wherein the check valve assembly is fluidly coupled with the outlet tube.

6. The siphon powered suction device of claim 5, wherein the check valve assembly further comprises a rod, a first geometric end at one end of the rod, and a second geometric end at the other end of the rod, with the first geometric end and the second geometric end shaped to seal to a respective end of the outlet tube dependent upon an orientation of the central member, with the rod having a corrugation along a length of the rod.

7. The siphon powered suction device of claim 1, further comprising a support structure for a rotational operation of the central member and removal of a fluid from at least one of the central member, the first vessel, and the second vessel when the first and second vessels are received in the cavities.

8. The siphon powered suction device of claim 1, wherein the elastomeric mechanism includes an elastomeric material allowing for a second sealing of one of an inner diameter and an outer diameter of each of the first vessel and the second vessel to a respective cavity.

9. The siphon powered suction device of claim 2, further comprising a kit incorporating the central member, the check valve assembly, the inlet tube, and the outlet tube.

10. A rotational siphon powered suction device comprising:

a housing with an inlet port and a diametrically opposed outlet port, and further with a first opening and a second diametrically opposed second opening;

an inlet aperture fluidly connected to the inlet port;

an outlet aperture fluidly connected to the outlet port;

an inlet tube in operative contact with the inlet aperture for receipt of a combustion emission from the inlet aperture;

an outlet tube operatively connected to the outlet aperture for transmission of the combustion emission out of the device;

a first elastomeric seal for coupling a first vessel to the first opening of the housing; and a second elastomeric seal for coupling a second vessel to the second opening of the housing.

11. The rotational siphon powered suction device of claim 10, wherein the inlet aperture is molded into a central member of the housing and the inlet tube is positioned substantially orthogonal to the inlet aperture; and wherein the outlet aperture is molded into the central member opposite the inlet aperture and the outlet tube is positioned substantially orthogonal to the outlet aperture.

12. The rotational siphon powered suction device of claim 10, further comprising a check valve assembly is positioned through fluidly coupled with the outlet tube, the check valve assembly having:

a rod, a first geometric end at one end of the rod, and a second geometric end at the other end of the rod, with the first geometric end and the second geometric end shaped to seal to a respective end of the outlet tube dependent upon an orientation of the housing; and the rod having a corrugation along a length of the rod.

13. The rotational siphon powered suction device of claim 10, further comprising a support structure for a rotational operation of the housing and removal of a fluid from at least one of the housing, the first vessel, and the second vessel when the first vessel and the second vessel are sealably coupled to the housing.

14. The rotational siphon powered suction device of claim 10, further comprising a rotational inlet accessory sealably attached to the inlet aperture through the inlet port.

* * * * *